US007571839B2

(12) United States Patent
Chu et al.

(10) Patent No.: US 7,571,839 B2
(45) Date of Patent: Aug. 11, 2009

(54) PASSIVE EXOSKELETON

(75) Inventors: Conrad Chu, Piscataway, NJ (US); Andy Chu, Cambridge, MA (US)

(73) Assignee: HRL Laboratories, LLC, Malibu, CA (US)

( * ) Notice: Subject to any disclaimer, the term of this patent is extended or adjusted under 35 U.S.C. 154(b) by 725 days.

(21) Appl. No.: 10/850,202

(22) Filed: May 19, 2004

(65) Prior Publication Data

US 2005/0279796 A1 Dec. 22, 2005

(51) Int. Cl.

| | |
|---|---|
| ***A45C 1/04*** | (2006.01) |
| ***A45F 3/00*** | (2006.01) |
| ***A45F 0/14*** | (2006.01) |
| ***A61H 3/00*** | (2006.01) |
| ***A63B 25/00*** | (2006.01) |
| ***A63G 13/00*** | (2006.01) |

(52) U.S. Cl. ..... 224/637; 224/661; 224/662; 224/671; 224/674; 224/679; 224/680; 224/222; 135/67; 482/75; 280/1.181

(58) Field of Classification Search ..... 224/637, 224/661, 662, 904, 222, 671, 674, 679, 680; 135/37, 67; 482/75, 51, 52, 70; 280/1.181
See application file for complete search history.

(56) References Cited

U.S. PATENT DOCUMENTS

| | | | | | |
|---|---|---|---|---|---|
| 406,328 | A | * | 7/1889 | Yagn | 482/77 |
| 420,178 | A | * | 1/1890 | Yagn | 482/51 |
| 420,179 | A | * | 1/1890 | Yagn | 482/51 |
| 440,684 | A | * | 11/1890 | Yagn | 482/51 |
| 807,908 | A | * | 12/1905 | Bradstreet | 482/51 |
| 979,243 | A | * | 12/1910 | Anderson | 482/51 |
| 1,308,675 | A | * | 7/1919 | Kelley | 482/51 |
| 2,010,482 | A | * | 8/1935 | Cobb | 623/31 |
| 2,351,145 | A | * | 6/1944 | Pearson | 623/28 |
| 3,346,882 | A | * | 10/1967 | Wilhoyte | 623/28 |
| 3,902,199 | A | * | 9/1975 | Emmert | 623/28 |
| 4,872,665 | A | * | 10/1989 | Chareire | 482/51 |
| 4,969,452 | A | * | 11/1990 | Petrofsky et al. | 602/16 |
| 5,060,640 | A | * | 10/1991 | Rasmusson | 602/16 |

(Continued)

OTHER PUBLICATIONS

Chu, Andrew; Design Overview of 1st Generation Exoskeleton; Apr. 3, 2003; Master of Science Thesis Mechanical Engineering at the University of California, Berkeley; pp. 1-62.*

(Continued)

*Primary Examiner*—Nathan J Newhouse
*Assistant Examiner*—Lester L Vanterpool
(74) *Attorney, Agent, or Firm*—Tope-McKay & Associates

(57) ABSTRACT

The present invention relates to a load bearing apparatus, and more particularly, to a passive exoskeleton whereby a load may be placed on the passive exoskeleton and thereby transfer weight of the load from the passive exoskeleton to a ground surface. The passive exoskeleton comprises a rigid body member for attaching proximate a portion of a user's body, a sliding rod attached with the body member, and a ground surface engage-able foot analog attached with the sliding rod. When a user places a load on the body member, weight of the load from is transferred from the body member, through the sliding rod, and into the foot analog, causing the passive exoskeleton to support at least a portion of the load.

14 Claims, 30 Drawing Sheets

U.S. PATENT DOCUMENTS

| | | | | |
|---|---|---|---|---|
| 5,340,139 | A * | 8/1994 | Davis | 280/304.1 |
| 5,348,035 | A * | 9/1994 | Porter | 135/66 |
| 5,568,887 | A * | 10/1996 | Gollihue et al. | 224/661 |
| 5,588,456 | A * | 12/1996 | Hart | 135/67 |
| 5,645,515 | A * | 7/1997 | Armstrong et al. | 482/75 |
| 5,658,242 | A * | 8/1997 | McKay et al. | 602/16 |
| 6,015,076 | A | 1/2000 | Pennington | |
| 6,263,892 | B1 * | 7/2001 | Baker | 135/66 |
| 6,517,586 | B2 * | 2/2003 | Lin | 623/28 |
| 6,648,803 | B1 * | 11/2003 | Jay | 482/76 |
| 6,676,707 | B2 * | 1/2004 | Yih et al. | 623/24 |
| 6,832,770 | B1 * | 12/2004 | Wright-Ott et al. | 280/87.041 |
| 7,108,640 | B2 * | 9/2006 | Emmert | 482/75 |
| 7,278,979 | B2 * | 10/2007 | Shimada et al. | 602/16 |
| 2003/0000986 | A1 * | 1/2003 | Smith | 224/637 |

OTHER PUBLICATIONS

Lim, Michael Zin Min; An Analysis on the Performance of an Underactuated Lower Extremity Enhancer; Dec. 20, 2000; Master of Science Thesis Mechanical Engineering at the University of California, Berkeley; pp. 1-33.*

Sankai Y, Kawamoto H.; Comforatable Power Assist Control Method for Walking Aid by HAL-3; 2002; Sankai Lab at the Institute of Engineering Mechanics and Systems, University of Tsukuba, Japan, pp. 1-6.*

Pratt, Jerry E., Krupp, Benjamin T., and Morse, Christopher J.; the Roboknee: An Exoskeleton for Enhancing Strength and Endurance During Walking, Apr. 2004, International Conference of Robotics & Automation, pp. 2430-2435.*

* cited by examiner

PASSIVE EXOSKELETON

BACKGROUND OF INVENTION (1) Field of Invention

The present invention relates to a load bearing apparatus, and more particularly, to a passive exoskeleton onto which a load may be placed, with the weight of the load transferred from the passive exoskeleton to a ground surface, causing the passive exoskeleton to support at least a portion of the load.

(2) Background of Invention

Load bearing devices have long been known in prior art. For example, backpacks with frames have long been employed to reduce a load carried by an individual's shoulders. Although the backpack functions to distribute the load, the weight of the load is transferred to the individual's hips, forcing the individual to ultimately bear the burden of the load. Because of the necessity to bear the burden of the load, the amount of weight an individual may carry using a traditional backpack is limited.

Other examples of load bearing devices include orthopedic devices such as canes, crutches, and walkers. Although orthopedic devices transfer the load to the ground, they generally operate under an assumption that the user must be able to stand and carry his/her own weight. Many orthopedic devices require the user's upper torso to be continuously used and such devices generally are not useful when upper limbs must remain free and unoccupied.

Another example of an orthopedic device is disclosed in U.S. Pat. No. 6,015,076, issued to Pennington ("the Pennington Patent"). The Pennington Patent discloses a hip belt which reduces fatigue by bridging across muscles and nerves in the gluteal region. A drawback of devices made according to this particular prior art is that all of the weight is still carried by the individual's skeletal and muscular system.

In an effort to reduce the load placed on the user's skeletal and muscular system, powered exoskeletons have been proposed. Powered exoskeletons mimic the function of body joints by using actuators or artificial muscles. The actuators required for these exoskeleton concepts consume significant power, supplies for which are either difficult to produce or are currently unavailable. Additionally, the compact actuator (artificial muscle) technology has currently not progressed enough to make such devices practical. As such, the concept of a futuristic soldier using a powered exoskeleton, requires further developments in a variety of fields, including actuation, artificial muscles, and advanced energy storage. Given the current state of these technologies, powered exoskeletons may not be realized for decades to come.

It can be appreciated that there exists a continuing need for a passive exoskeleton that bears at least a portion of the weight of a load placed on an individual's skeletal and muscular system and transfers the weight to a ground surface. The present invention substantially fulfills this need.

SUMMARY OF INVENTION

The present invention relates to a load bearing apparatus, and more particularly, to a passive exoskeleton whereby a load may be placed on the passive exoskeleton and thereby transfer weight of the load from the passive exoskeleton to a ground surface.

The passive exoskeleton comprises a body member for attaching proximate a portion of a user's body; a sliding rod attached with the body member; and a ground surface engageable foot analog attached with the sliding rod. A user may place a load on the body member and thereby transfer weight of the load from the body member, through the sliding rod, and into the foot analog, causing the passive exoskeleton to support at least a portion of the load.

The sliding rod further comprises an alignment rod and a load rod. The alignment rod has a top portion, a bottom portion, and a length with an axis therethrough. The top portion of the alignment rod is pivotally attached with the body member, and the load rod is in a fixed parallel alignment with the axis of the alignment rod. The load rod has a top part and a bottom part. Additionally, the load rod is connected with the alignment rod such that a length of the sliding rod is adjustable by sliding the top part of the load rod between the bottom portion and top portion of the alignment rod.

In another aspect, the body member is rigid, allowing the passive exoskeleton to transfer weight from the body member and through the passive exoskeleton to the ground surface.

In yet another aspect, the load rod further comprises an ankle joint attached with the bottom part of the load rod, where the ankle joint pivotally connects the load rod with the foot analog.

Additionally, the passive exoskeleton further comprises a rocker pivotally attached with the body member. The rocker has a travel channel and a load channel, with the travel channel and the load channel being incorporated therein. The travel channel is an elongated channel constructed such that the travel channel is oriented directionally from proximate the body member to the ground surface. The load channel is an elongated channel positioned such that an angle between the load channel and the travel channel is less than ninety degrees.

Additionally, a load pin is attached with the top part of the load rod. The load pin is operably attached with the rocker through both the travel channel and the load channel. As a user walks and shifts from a swing phase to a stance phase, the load is transferred from the body member to the rocker, the shift causing the load pin to travel between the travel channel and the load channel, thereby shifting the load from the rocker onto the load pin and thereafter through the load rod and the foot analog to the ground surface.

Furthermore, the rocker has a first side and a second side, and both the travel channel and the load channel pass through the rocker from the first side to the second side.

In yet another aspect, the passive exoskeleton further includes a front rocker stop and a rear rocker stop, both being attached with the body member. Additionally, the rocker further comprises a top component for engaging with both the front and rear rocker stops. When a user is walking, the rocker travels from a forward position to a rear position. When the rocker is in a forward position, the top component engages with the rear rocker stop, and when the rocker is in a rear position, the top component engages with the front rocker stop.

In another aspect, the passive exoskeleton further comprises a foot connector attached with the foot analog. A user may utilize the foot connector to securely attach the foot analog with the user's foot or shoe, thereby allowing the foot analog to maintain a position proximate the user's foot.

The passive exoskeleton further comprises a body attachment attached with the body member. The body attachment is selected from a group consisting of a flexible harness, a belt, and suspenders. The body attachment is for attaching with a torso portion of a user, allowing the user to operate the exoskeleton and maintain the exoskeleton in a position proximate the user.

Additionally, the passive exoskeleton further comprises a load frame attached with the body member, whereby a user may attach a load with the load frame and thereby transfer weight from the load, through the exoskeleton and to the ground surface.

Finally, it can be appreciated by one in the art that the present invention also comprises a method for making the apparatus described herein.

BRIEF DESCRIPTION OF THE DRAWINGS

The nature of the passive exoskeleton described herein will be readily apparent with reference to the description below taken in conjunction with the following drawings, in which.

DETAILED DESCRIPTION

The present invention relates to a load bearing apparatus, and more particularly, to a passive exoskeleton that permits a load to be placed on the passive exoskeleton for at least a portion of the weight of the load to be transferred directly from the passive exoskeleton to a ground surface, causing the passive exoskeleton to support at least a portion of the load.

The following description, taken in conjunction with the referenced drawings, is presented to enable one of ordinary skill in the art to make and use the invention. Various modifications will be readily apparent to those skilled in the art, and the general principles defined herein may be applied to a wide range of aspects. Thus, the present invention is not intended to be limited to the aspects presented, but is to be accorded the widest scope consistent with the principles and novel features disclosed herein. Furthermore, it should be noted that unless explicitly stated otherwise, the figures included herein are illustrated qualitatively and without any specific scale, and are intended to generally present the concept of the present invention.

In order to provide a working frame of reference, first a glossary of terms used in the description and claims is given as a central resource for the reader. Next, a discussion of gait kinematics is provided to give an understanding of the specific details of the present invention.

(1) Glossary

Before describing the specific details of the present invention, a centralized location is provided in which various terms used herein and in the claims are defined. The glossary provided is intended to provide the reader with a general understanding for the intended meaning of the terms, but is not intended to convey the entire scope of each term. Rather, the glossary is intended to supplement the rest of the specification in more clearly explaining the terms used.

Exoskeleton—The term "exoskeleton" refers to a load bearing apparatus for attaching with a user.

Foot-Analog—The term "foot-analog" refers to a structure or device that is similar to a foot of a being in that it is engageable with a ground surface.

Gait Kinematics—The term "gait kinematics" refers to body mechanics associated with walking or stepping.

(2) Gait Kinematics

Figure 1:
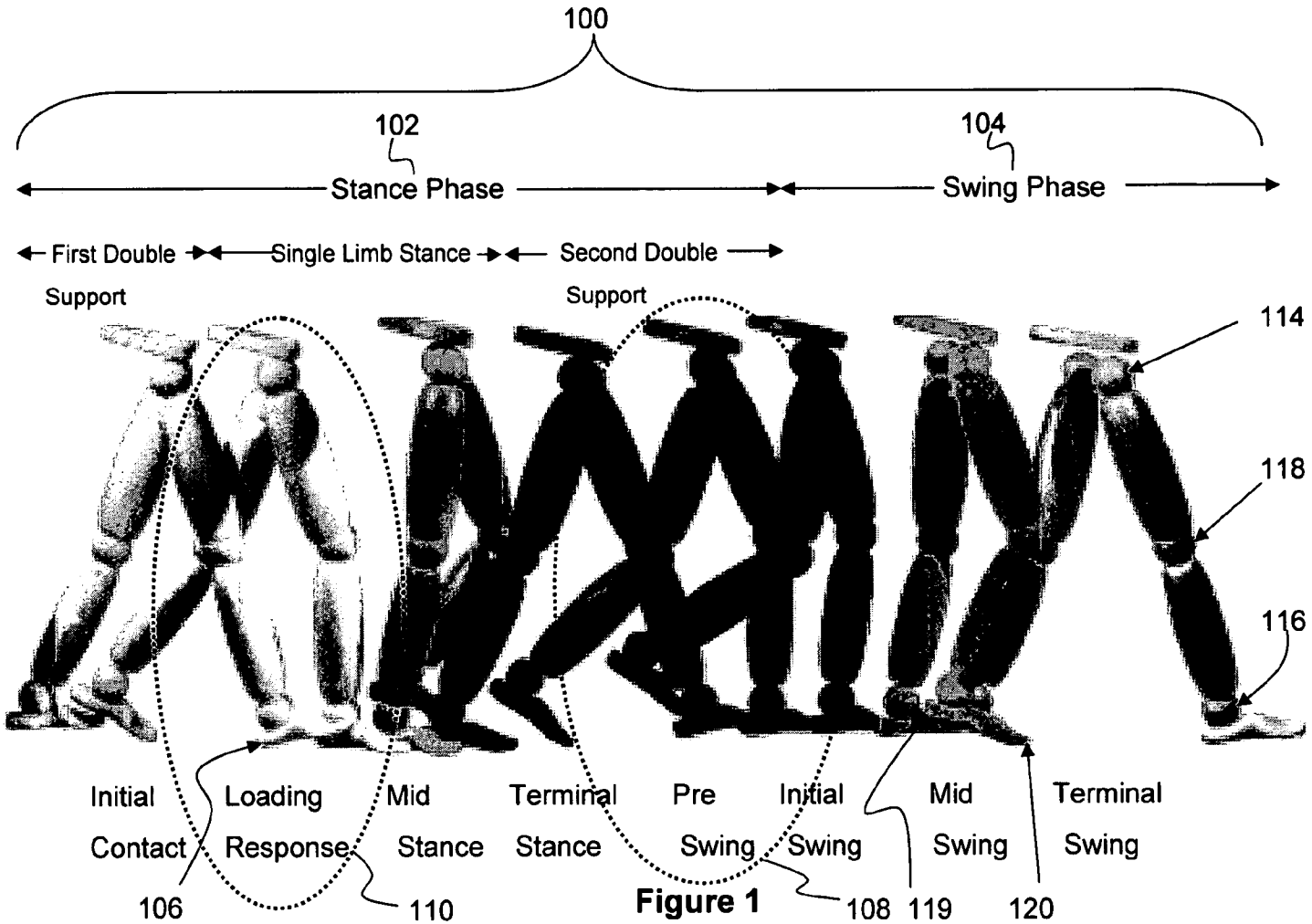
FIG. 1 is an illustration of gait kinematics, illustrating a stance phase and a swing phase of an individual's gait.

The present invention relates to a load-bearing passive exoskeleton. In order to better understand the invention, some introductory remarks are provided to help explain gait kinematics. As shown in FIG. 1, the gait cycle 100 can be divided into two phases: a stance phase 102 and a swing phase 104. As shown in FIG. 1, the stance phase 102 accounts for approximately sixty percent (60%) of the gait cycle 100 during walking. It starts at heel-strike (initial contact) 106 and ends at toe-off (pre-swing) 108. The swing phase 104 accounts for approximately 40% of the gait cycle 100 and is when the limb is not loaded. So, for example, when one limb is in a loading response 110, the other limb is in a pre-swing 108.

In order for the passive exoskeleton to function properly, two fundamental criteria should be met: (1) a rod (brace) should support a load during the stance phase 102, but not inhibit motion during the swing phase 104, and (2) the rod (brace) must allow a normal range of motion, while comfortably supporting a load.

There are a number of ways that such a structure could support a load. One possibility is to have a rigid rod that maintains a fixed distance between a hip 114 and an ankle 116. Since a user's knee 118 would be locked in this case (i.e. it doesn't bend), the user would be forced to walk unnaturally, with unbending knees. Although the rod could hold part of the weight of the load, such a device would be uncomfortable because of the "unbent knee."

Another possibility would be to have two rods connected by a hinge joint at the knee 118. A problem with this however is that a hinge cannot support weight by itself. In this case, a user would need to use leg muscles acting at the knee 118 to prevent falling. Similarly, a hinged brace would require a muscle or actuator to mimic the function of the knee 118. Such a system, however, is not practical using current actuator technologies. Instead of adding complexity and requiring self-contained power to drive these actuators, the present invention pursues a different strategy, to create a simple device that requires no electrical power.

One possible passive solution would be to use a spring at the hinged knee joint. The spring could take up part of the load and act as the constant muscle for the knee joint. Adding a spring would allow some bending of the knee 118 and better gait kinematics. A problem with this approach, however, is that the system should carry the load during the stance phase 102, but not resist the leg force during the swing phase 104 (when the leg is swinging forward and is not supporting the weight). Otherwise, the benefit in having the device support the load during the stance phase 102 of the stride would be negated during the swing phase 104 of the stride. In this example, any time the knee 118 is bent, force must be exerted to compress the spring. After heel-strike 106, during the stance phase 104 of the gait cycle 100, a spring would be desirable because the weight of the load is used to compress the spring. However, after toe-off and during the swing phase 104, the spring is undesirable because the user must use considerable force to bend the knee 118 and bring up the heel 119 to allow the toe 120 to clear the ground during the swing phase 104. During the swing phase 104, the user would be "fighting the spring."

Another possible solution is to have one rigid rod between the hip 114 and ankle 116, but to allow the user's knee 118 to bend. The difficulty with this solution is that when the user's knee 118 bends, the distance between the hip 114 and ankle 116 varies. With a single rod, this would result in the rod protruding above the user's hip 114 when the knee 118 is bent. In this configuration, the load may be attached with the end of the rod, to allow its weight to be transferred to the rod. Therefore, the load would bounce up and down during walking. Furthermore, this system would still require the user to lift the entire weight of the load when bring up his heel, similar to the "fighting the spring" problem previously described.

The solution proposed by the present invention de-couples the stance 102 and swing 104 phases of walking. This allows the exoskeleton to bear a load during the stance phase 102, but to bear substantially no load during the swing phase 104 (recovery), so the individual does not fight the device when swinging a leg forward. This can be accomplished through use of the exoskeleton described herein. Since the distance between the hip 114 and ankle 116 is also allowed to vary, the knee 118 can be bent and the user does not have the "unbent knee" problem. On the other hand, the rod bears no load during the swing phase 104 (recovery) so there is no "fighting the spring" problem. In addition, a mechanism at the ankle 116 allows the weight of the load to be transferred to a ground surface and eliminates the need for the user to exert extra effort to lift his ankle 116 during the swing phase 104. The details of the exoskeleton described herein are further described below.

(3) Discussion

Figure 2:
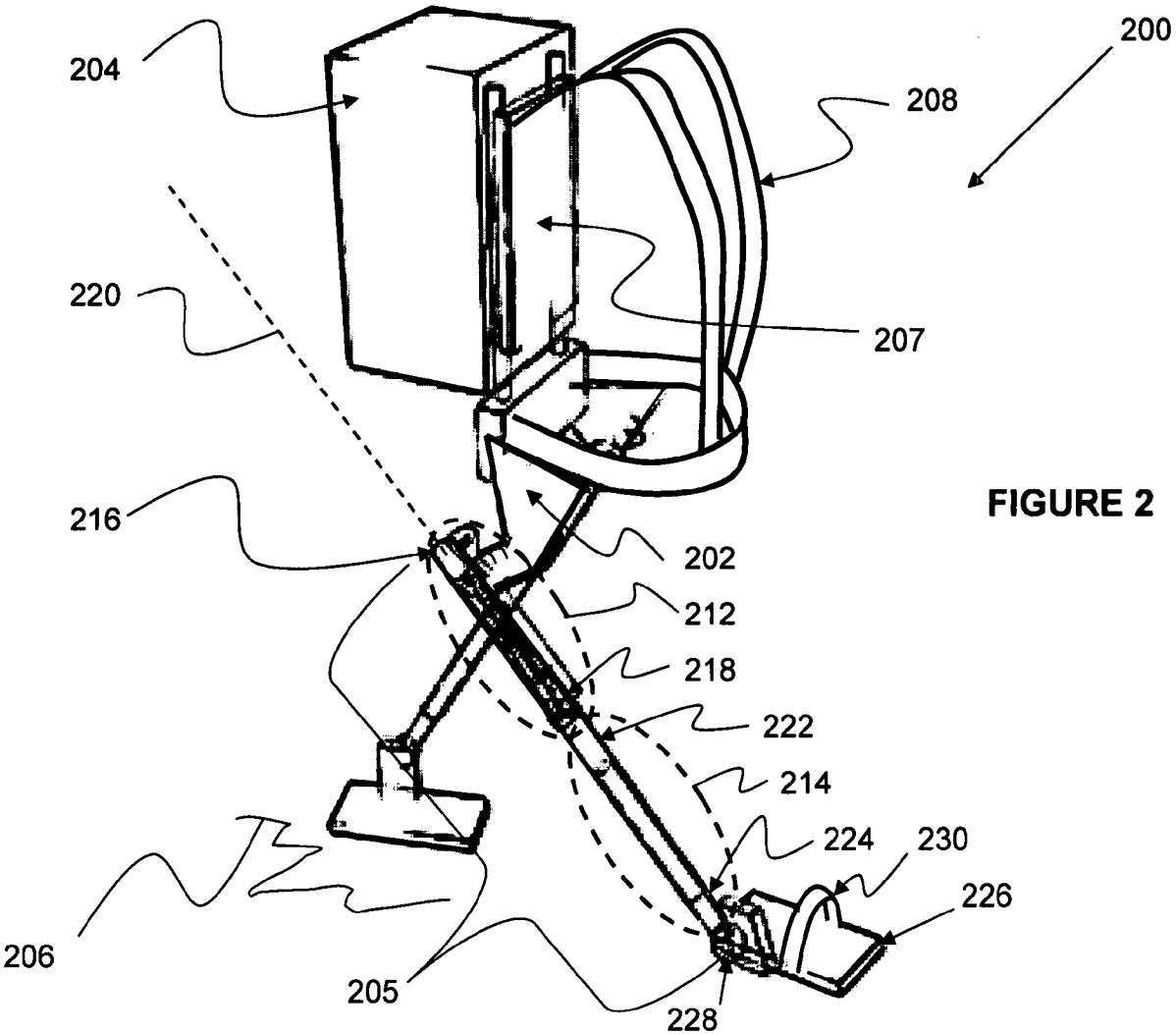
FIG. 2 is an illustration of a side perspective view of a passive exoskeleton according to the present invention.

FIG. 2 illustrates a passive exoskeleton 200 according to the present invention. The exoskeleton 200 comprises a body member 202 for transferring weight of a load 204 to a sliding rod 205, and thereafter to a ground surface 206. Additionally, a load frame 207 may be attached with the body member 202, thereby allowing the load 204 to be secured with the exoskeleton 200. The body member 202 may be any suitable mechanism for transferring and bearing weight, non-limiting examples of which include a rigid plate and a rigid hip attachment. For example, the rigid hip attachment may be a metallic bar that wraps around a user's hip. In this aspect, weight of the load 204 would be transferred to the metallic bar, and thereafter through the connected sliding rod 205 and on to the ground surface 206.

Additionally, a body attachment 208 may be attached with the body member 202. The body attachment 208 is for attaching the exoskeleton 200 with a torso portion of a user, allowing the user to operate the exoskeleton 200 and maintain the exoskeleton 200 in a position proximate the user. The body attachment 208 may be any suitable mechanism or device for maintaining one object proximate another, non-limiting examples of which include a flexible harness, a belt, and suspenders.

The sliding rod 205 is attached with the body member 202. The sliding rod 205 is constructed of any suitably rigid material, a non-limiting example of which includes metal. The sliding rod 205 comprises an alignment rod 212 and a load rod 214. The alignment rod 212 has a top portion 216, a bottom portion 218, and a length with an axis 220 therethrough. The alignment rod 212 may be any suitable mechanism or device for maintaining an alignment of an object, non-limiting examples of which include a cylindrical tube, an elongated plate, a rod, and a metallic bar. The top portion 216 of the alignment rod 212 is attached with the body member 202 through any technique allowing movement therebetween, a non-limiting example of which includes being pivotally attached through use of a pin, or ball joint such as a hip joint.

The load rod 214 is in a fixed parallel alignment with the axis 220 of the alignment rod 212. The load rod 214 may be any suitable mechanism or device for bearing a load, non-limiting examples of which include a cylindrical tube, an elongated plate, a rod, and a metallic bar. The load rod 214 has a top part 222 and a bottom part 224, and is connected with the alignment rod 212 such that a length of the sliding rod 205 is adjustable by sliding the top part 222 of the load rod 214 between the bottom portion 218 and top portion 216 of the alignment rod 212. As a non-limiting example, the alignment rod 212 is a cylindrical tube and is positioned within a larger cylindrical tube of the load rod 214, allowing the two rods to be slid past each other and thereby vary the length of the sliding rod 205.

In order to transmit the weight of the load 204 to the ground, the load rod 214 must be connected to something in contact with the ground. This is accomplished through use of a ground surface engage-able foot analog 226 that is attached with the bottom part 224 of the load rod 214. The foot analog 226 is attached with the load rod 214 through any suitable mechanism or device allowing movement therebetween, a non-limiting example of which includes being pivotally attached through use of an ankle joint 228. The foot analog 226 is constructed such that it is engageable with both a ground surface and with a user's foot. As a non-limiting example, the foot analog 226 may be a platform for connecting with a bottom side of a user's shoe.

If the load rod 214 was only attached to the user's boot at the ankle with no foot analog 226, during toe-off the user would need to use a calf muscle to lift up the heel and thus the entire weight of the load 204. Having to lift the entire weight of the load 204 at each toe-off would be difficult to do and could present a significant mechanical burden. By using a foot analog 226 such as a platform, the load rod 214 is able to support the weight of the load 204 and transmit it to the ground without requiring additional effort from the user's calf muscle.

A foot connector 230 is attached with the foot analog 226, allowing a user to securely attach the foot analog 226 with the user's foot or shoe, thereby allowing the foot analog 226 to maintain a position proximate the user's foot. The foot connector 230 may be any suitable mechanism or device for fastening one object against another, non-limiting examples of which include Velcro straps, clips, and buckles.

Figure 3:
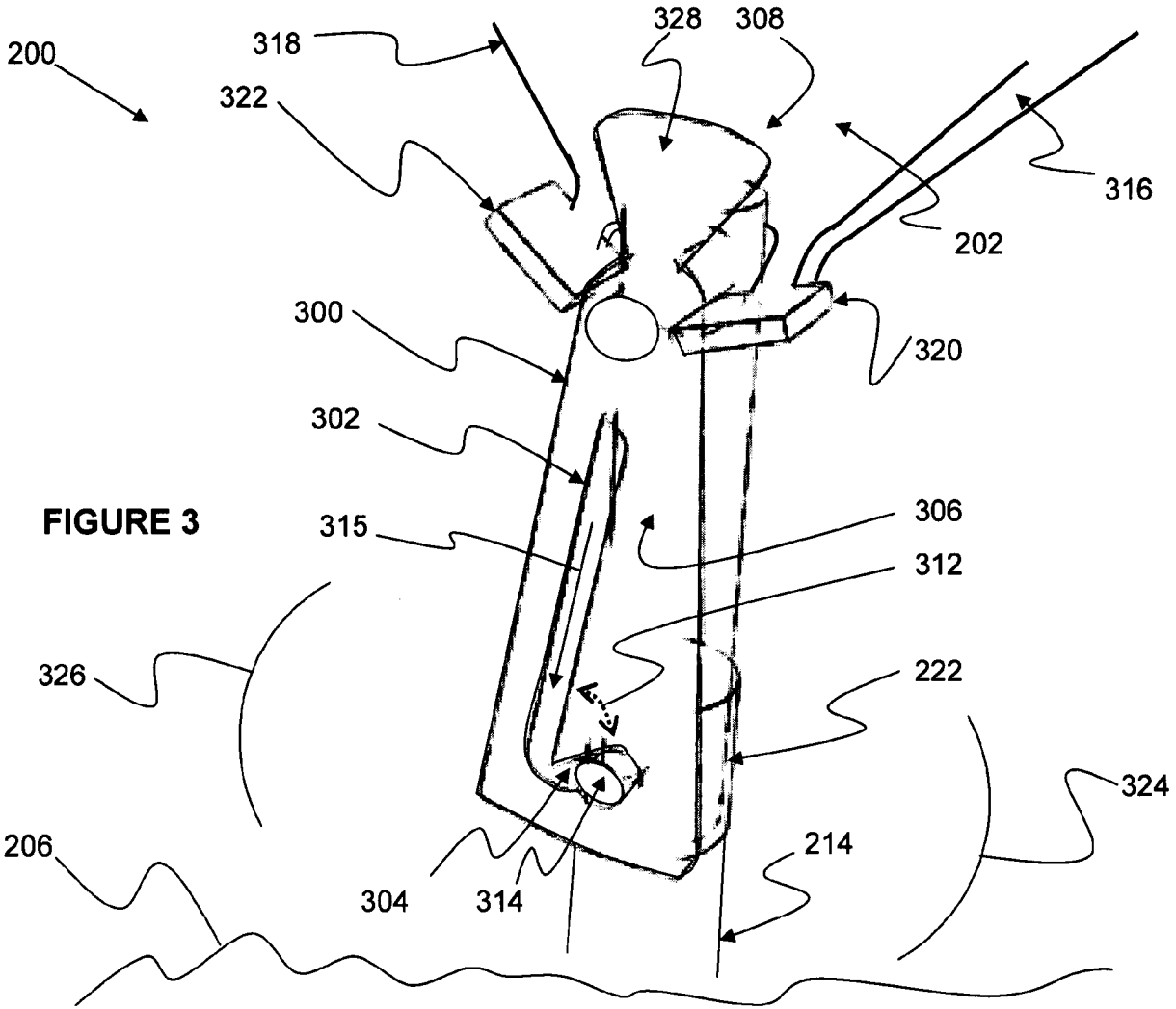
FIG. 3 is an illustration of a side perspective view of a rocker according to the present invention.

A user's leg can only support a load during the stance phase. For example, a user has two legs and as the user walks, each leg shifts between the stance and swing phases. While one leg is substantially in the swing phase, the other leg is substantially in the stance phase. Accordingly, during the swing phase, the other leg is supporting the load as it is in the stance phase. Therefore, the exoskeleton further comprises a rocker 300, as shown in FIG. 3. The rocker 300 helps support the weight of a load during the stance phase, but does not inhibit motion during the swing phase. The rocker 300 is attached with the body member 202 through any suitable mechanism or device allowing movement therebetween, a non-limiting example of which includes being pivotally attached through use of a pin or a ball joint. The rocker 300 has a travel channel 302 and a load channel 304 incorporated therein. Furthermore, both the travel channel 302 and the load channel 304 pass through the rocker 300 from a first side 306 to a second side 308.

The travel channel 302 is an elongated channel constructed such that it is oriented directionally from proximate the body member 202 to the ground surface 206. The load channel 304 is an elongated channel positioned such that an angle 312 between the load channel 304 and the travel channel 302 is less than ninety degrees.

A load pin 314 is attached with the top part 222 of the load rod 214. The load pin 314 is positioned such that it is operably attached with the rocker 300 through both the travel channel 302 and the load channel 304. When the load pin 314 is in the travel channel 302, the two rods can slide relative to one another and substantially no weight is carried by that particular rocker 300.

When a user walks and shifts from a swing phase to a stance phase, the shift causes the load pin 314 to travel down 315 the travel channel 302 and into the load channel 304, thereby shifting the load from the rocker 300, onto the load pin 314, and thereafter through the load rod 214 and the foot analog to the ground surface 206.

The body member 202 has a front side 316 and a rear side 318. A front rocker stop 320 is attached with the front side 316 of the body member 202 and a rear rocker stop 322 is attached with the rear side 318 of the body member 202. When a user is walking, the rocker 300 swings between a forward position 324 and a rear position 326. When the rocker is in a forward position 324, a top component 328 of the rocker 300 engages with the rear rocker stop 322. When the rocker 300 is in a rear position 326, the top component 328 engages with the front rocker stop 320.

Figure 4:
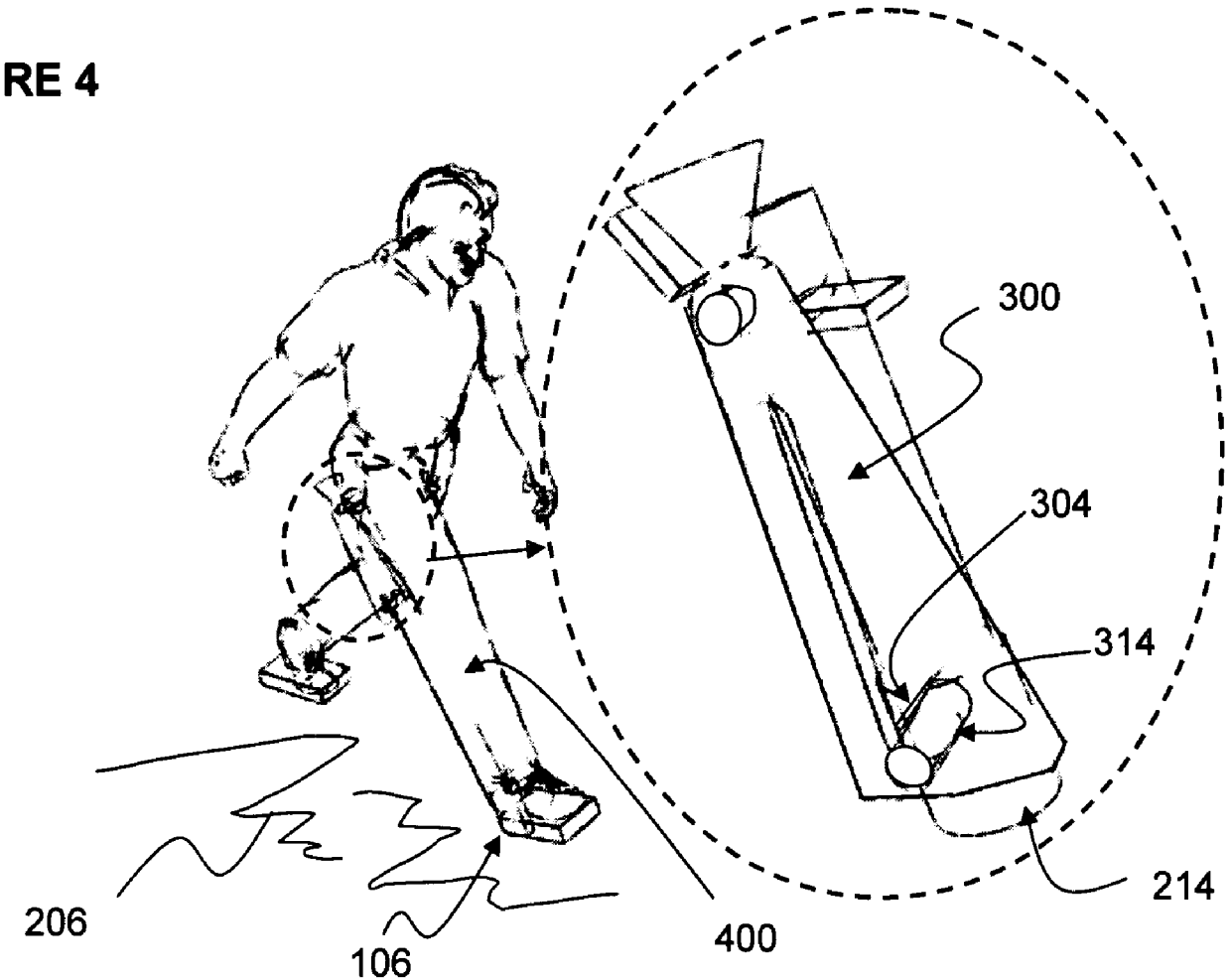
FIG. 4 is an illustration of a blown-up, side perspective view of a rocker according to the present invention, illustrating a position of a load pin in relation to the rocker during a stance phase.

As shown in FIG. 4, during heel-strike 106 (initial contact), the load pin 314 is in the load channel 304. As weight is transferred to a user's right leg 400, the weight of a load is transferred through the body member and rocker 300, via the load pin 314, to the load rod 214 and the ground 206. The rocker 300 continues to bear weight of the load during the stance phase as the load pin 314 remains in the load channel 304.

Figure 5:
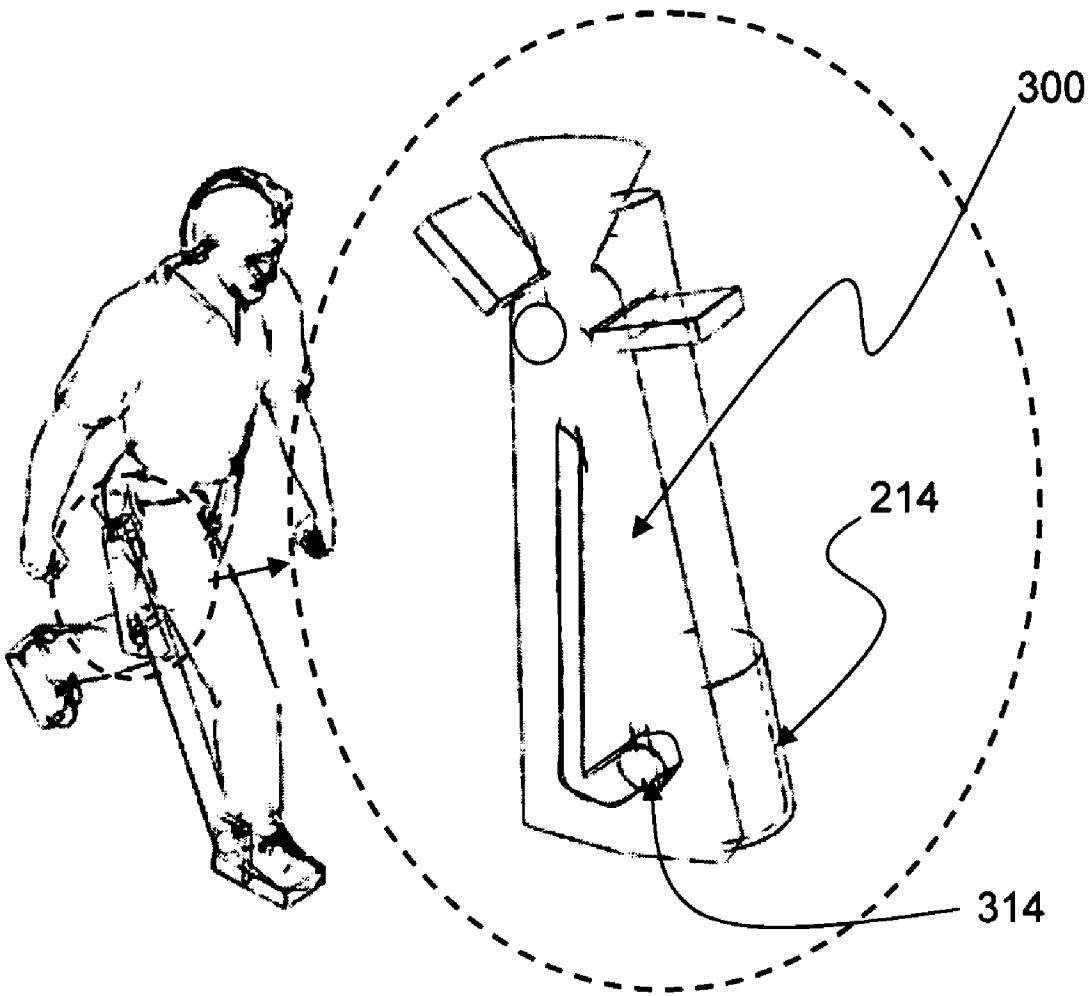
FIG. 5 is an illustration of a blown-up, side perspective view of a rocker according to the present invention, illustrating a position of the load pin in relation to the rocker during another stance phase.
Figure 6:
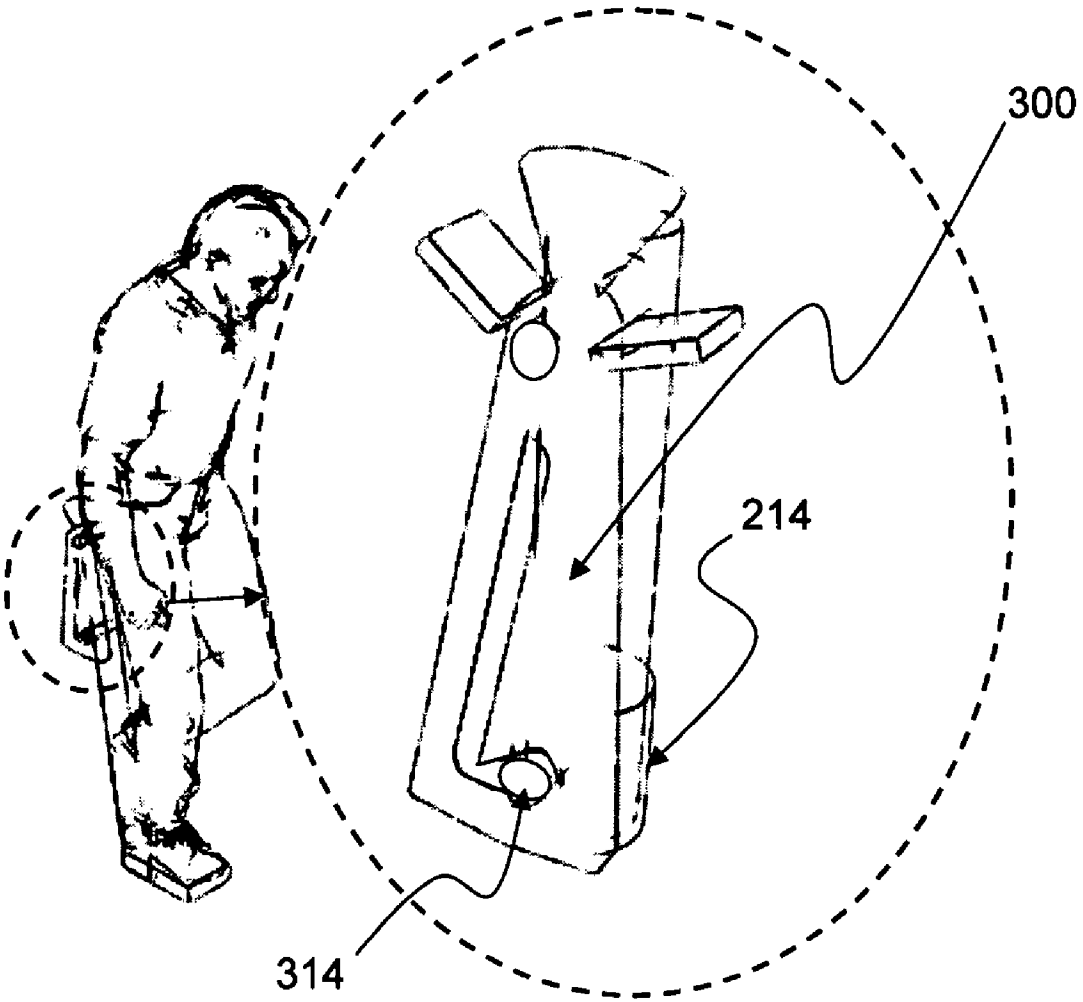
FIG. 6 is an illustration of a blown-up, side perspective view of a rocker according to the present invention, illustrating a position of the load pin in relation to the rocker during still another stance phase.
Figure 7:
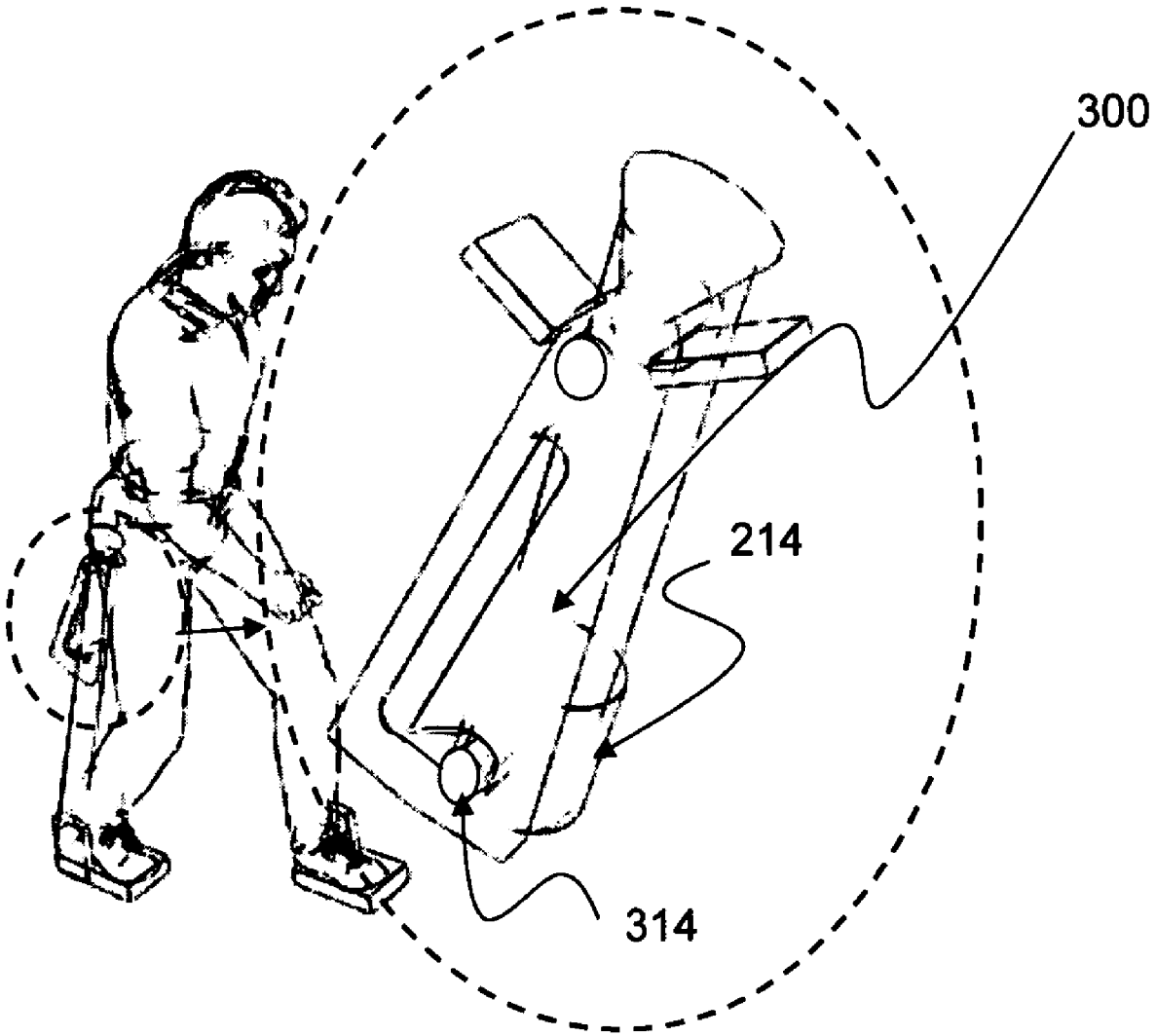
FIG. 7 is an illustration of a blown-up, side perspective view of a rocker according to the present invention, illustrating a position of the load pin in relation to the rocker during yet another stance phase.

FIGS. 5, 6, and 7 illustrate the loading response, mid stance and terminal stance positions respectively. As shown in FIGS. 5, 6 and 7, during these positions the weight of the load continues to be borne by the load pin 314, which transfers the weight from the rocker 300 to the load rod 214.

Figure 8:
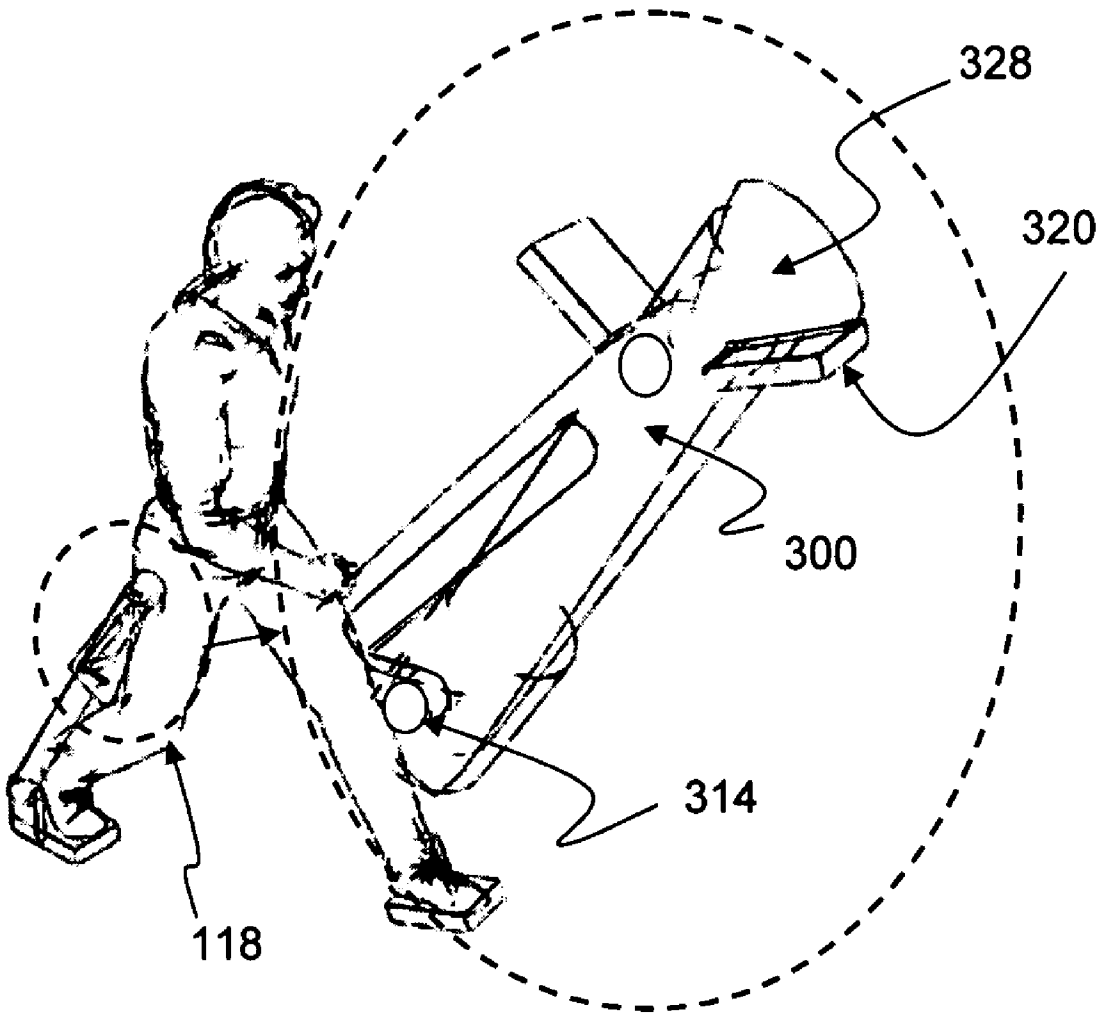
FIG. 8 is an illustration of a blown-up, side perspective view of a rocker according to the present invention, illustrating a position of the load pin in relation to the rocker during a further stance phase.

As shown in FIG. 8, the weight of the load continues to be borne by the load pin 314 until the pre-swing phase, just before toe-off. At this point, the top component 328 of the rocker 300 reaches the front rocker stop 320, which prevents further rotation of the rocker 300. Before completing the stance phase, the load pin 314 continues to move up and to the left since the right knee 118 is bending. However, once the rocker 300 can no longer rotate, the load pin 314 is forced up into the travel channel 302.

Figure 9:
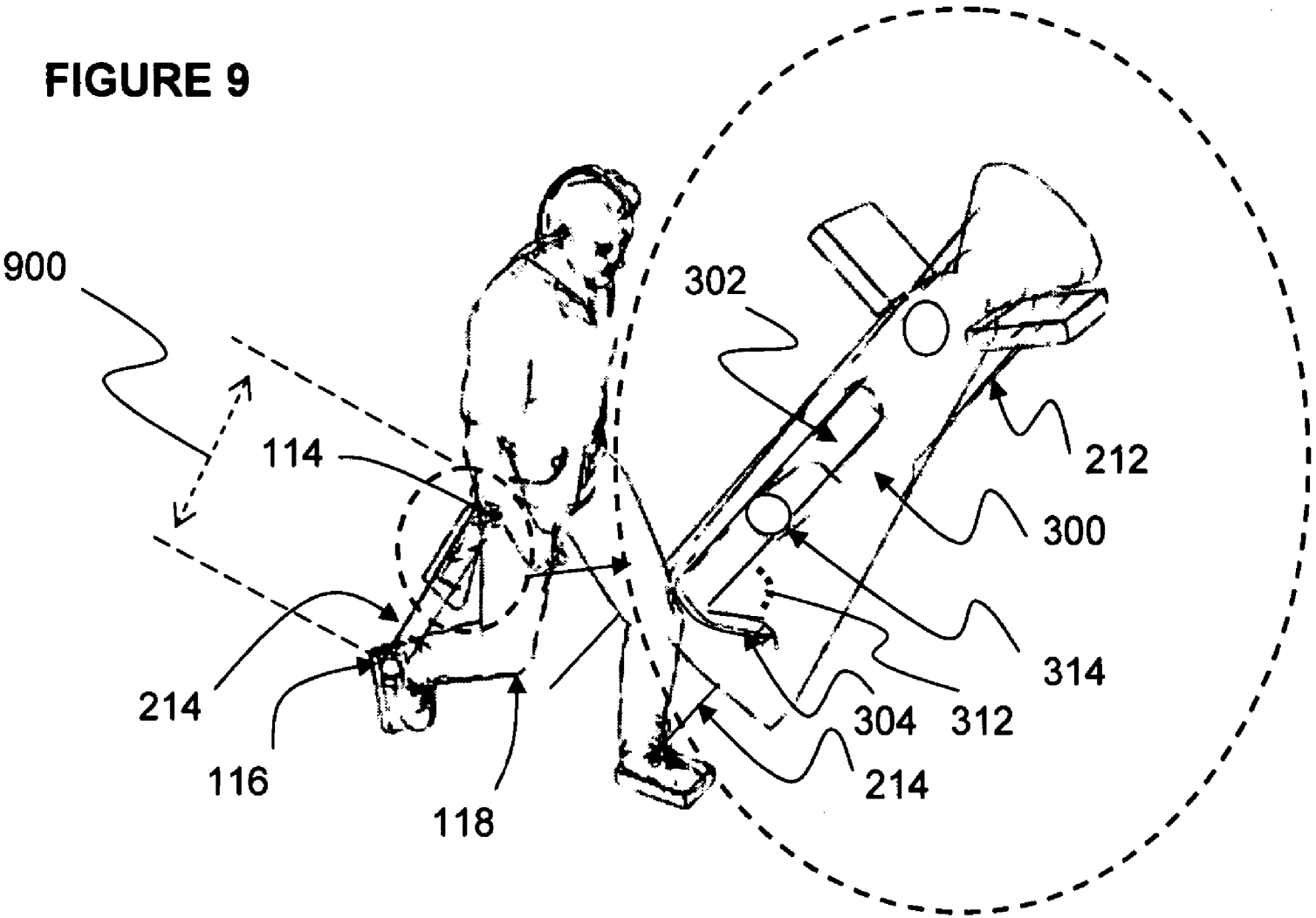
FIG. 9 is an illustration of a blown-up, side perspective view of a rocker according to the present invention, illustrating a position of the load pin in relation to the rocker during a swing phase.

As shown in FIG. 9, during the initial swing and as the knee 118 bends, the distance between the ankle 116 and hip 114 joint decreases. The load pin 314 then travels along the travel channel 302 and substantially no weight is transferred from the rocker 300 to the load rod 214.

The majority of variation in the hip-to-ankle distance 900 occurs during the swing phase. This is not a problem because the load pin 314 is in the travel channel 302 during this portion of the stride and the two rods (i.e. alignment rod 212 and load rod 214) can slide freely relative to one another. As long as the stance and swing phases can be de-coupled using the rocker 300, it is possible to use the rocker's 300 geometry in conjunction with a variety of springs and dashpots to smooth the motion. A spring placed in the load channel 304, for example, would help smooth the motion of the load pin 314 during the stance phase. This would also prevent the load pin 314 from reaching the base of the load channel 304 and would therefore allow a smaller angle 312 between the load channel 304 and the travel channel 302. This angle 312 could compensate for some variation in the hip-to-ankle distance 900 during the stance phase.

Figure 10:
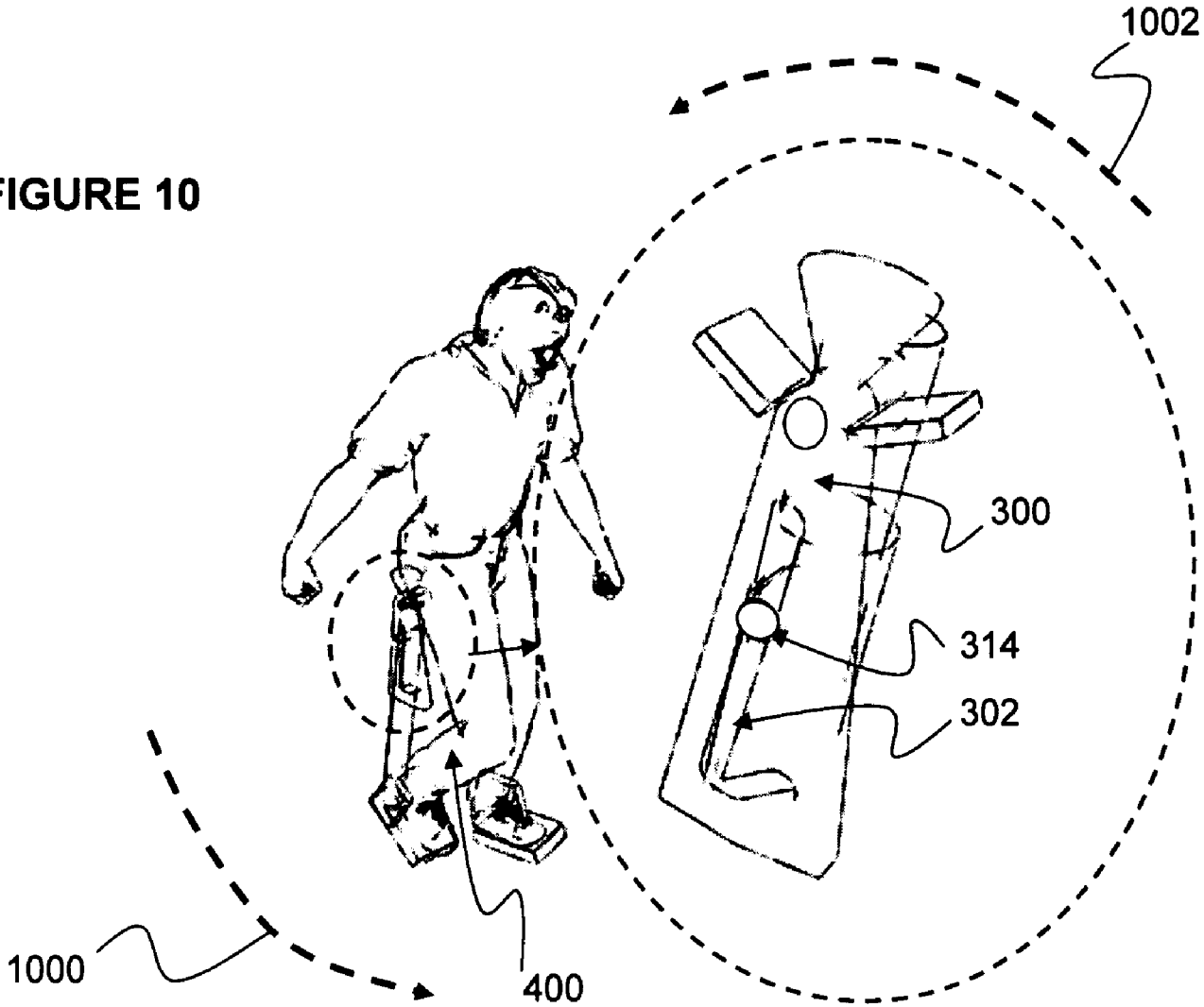
FIG. 10 is an illustration of a blown-up, side perspective view of a rocker according to the present invention, illustrating a position of the load pin in relation to the rocker during another swing phase.
Figure 11:
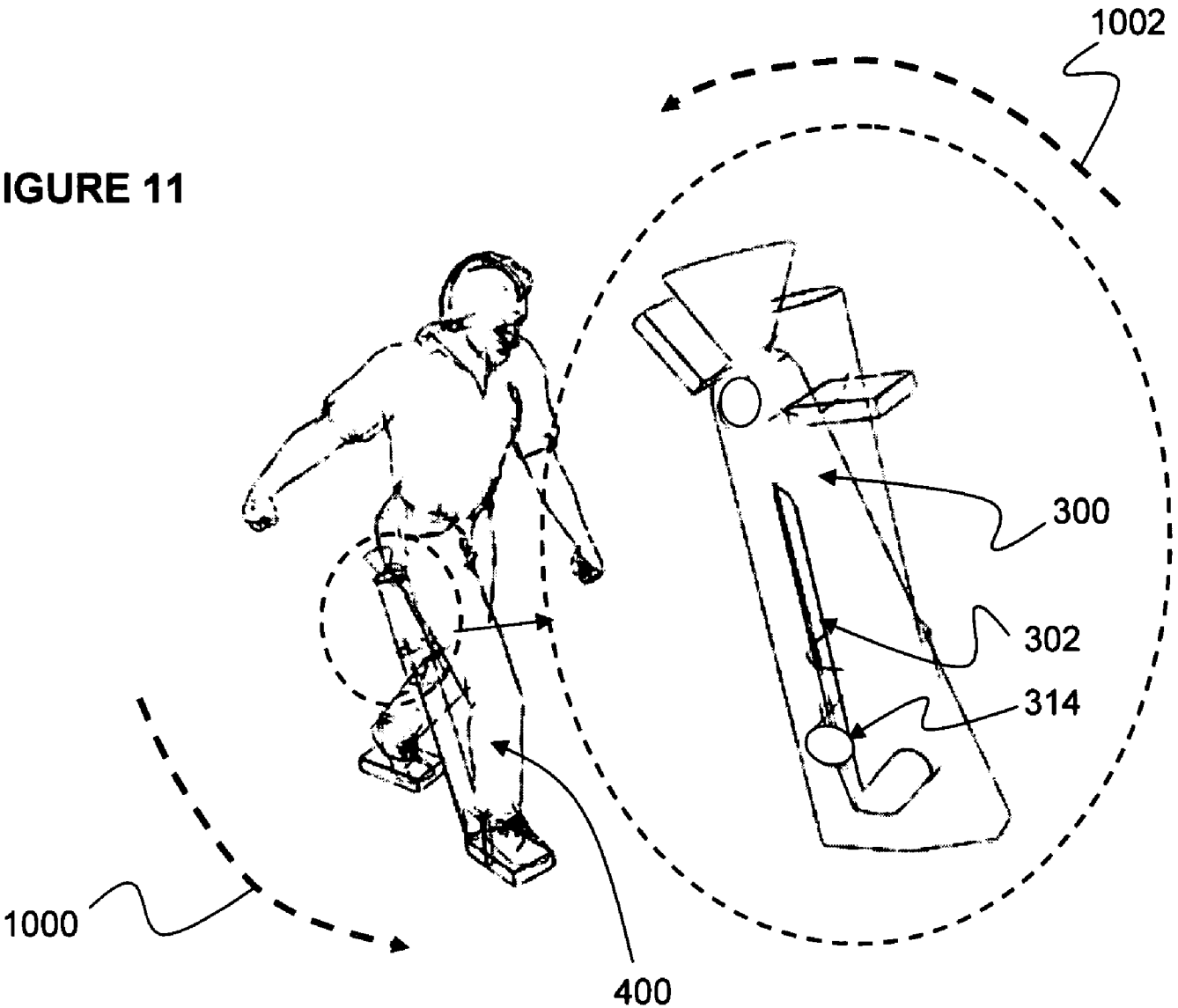
FIG. 11 is an illustration of a blown-up, side perspective view of a rocker according to the present invention, illustrating a position of the load pin in relation to the rocker during still another swing phase.

FIGS. 10 and 11 illustrate the mid swing and terminal swing positions respectively. As shown in FIGS. 10 and 11, as the user continues to walk and the leg 400 swings forward 1000, the rocker 300 rotates in a counter-clockwise direction 1002, with the load pin 314 continuing to travel along the travel channel 302. While traveling in the travel channel 302, the load pin 314 carries no load until the point where the right leg 400 is about to touch the ground again.

Figure 12:
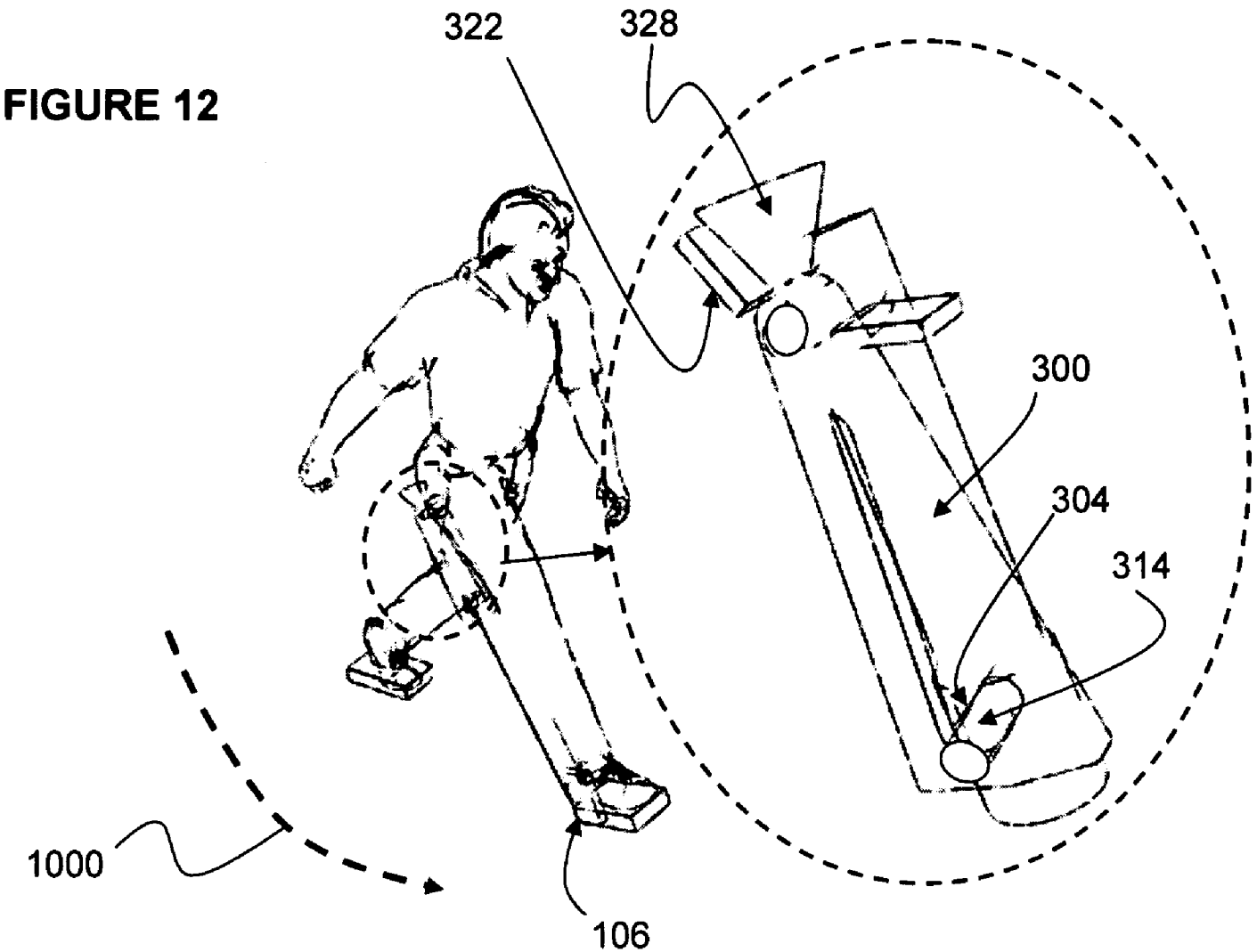
FIG. 12 is an illustration of a blown-up, side perspective view of a rocker according to the present invention, illustrating a position of the load pin in relation to the rocker during an end of the swing phase.
Figure 13B:
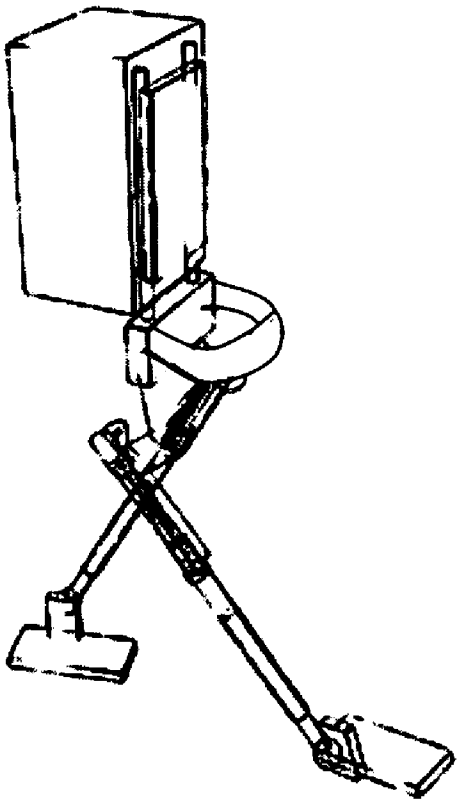
FIG. 13B is an illustration of the passive exoskeleton in the position as shown in FIG. 13A, without the user.
Figure 13A:
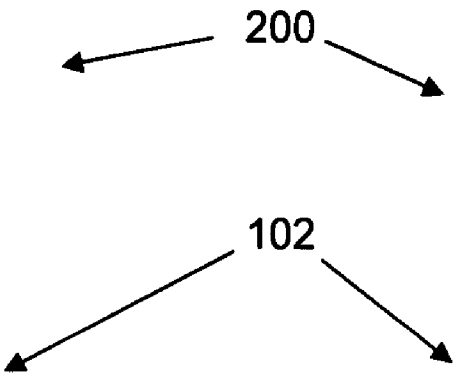
FIG. 13A is an illustration of a side perspective view of a passive exoskeleton attached with a user, where a right leg of a user is in an initial contact of a stance phase.
Figure 13A:
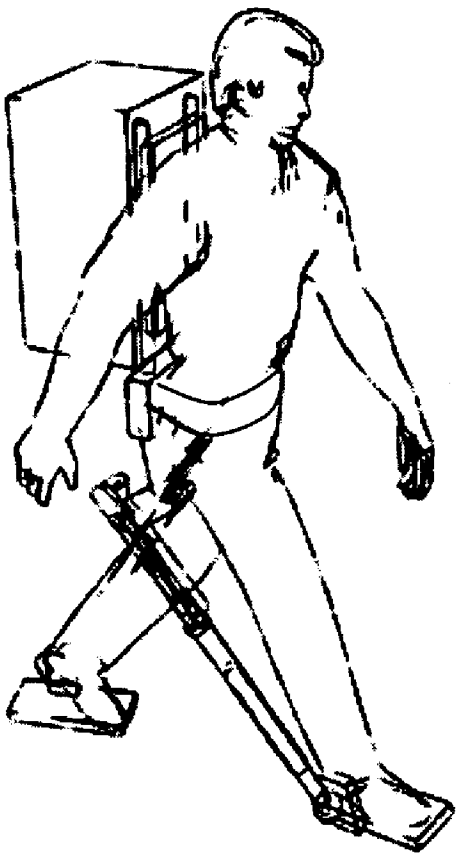
Figure 14B:
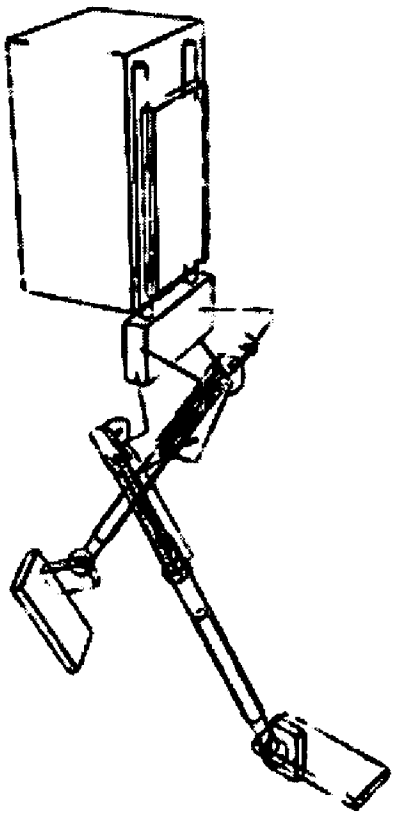
FIG. 14B is an illustration of the passive exoskeleton in the position as shown in FIG. 14A, without the user.
Figure 14A:
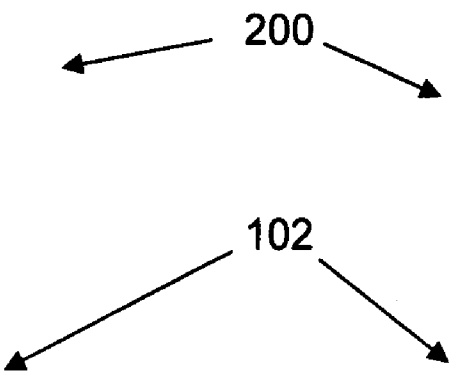
FIG. 14A is an illustration of a side perspective view of a passive exoskeleton attached with a user, where a right leg of a user is in a loading response of another stance phase.
Figure 14A:
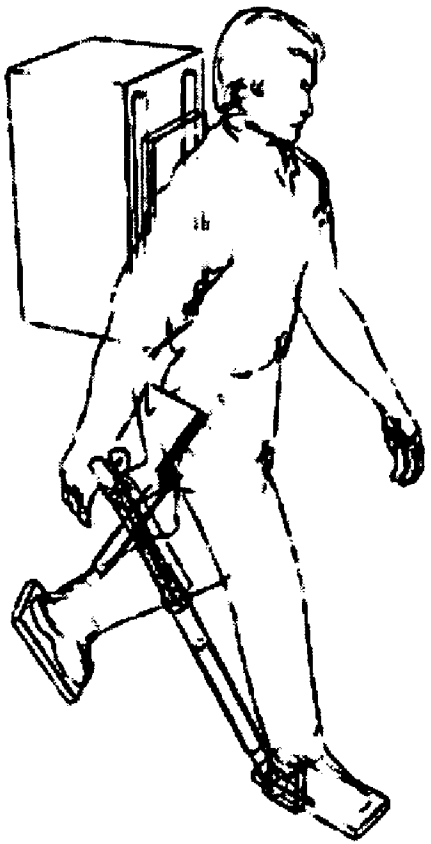
Figure 15B:
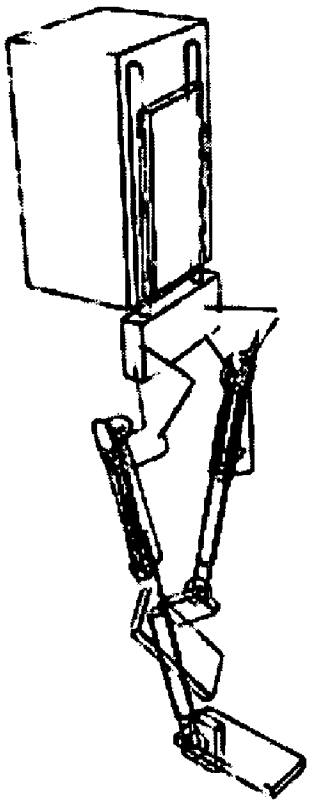
FIG. 15B is an illustration of the passive exoskeleton in the position as shown in FIG. 15A, without the user.
Figure 15A:
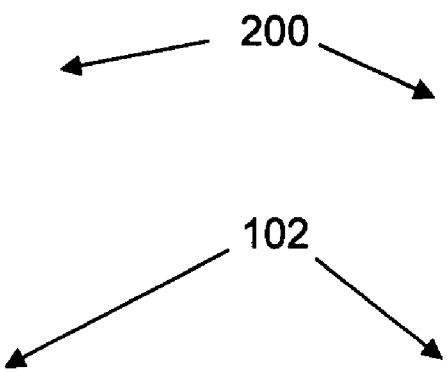
FIG. 15A is an illustration of a side perspective view of a passive exoskeleton attached with a user, where a right leg of a user is in a mid-stance of the stance phase.
Figure 15A:
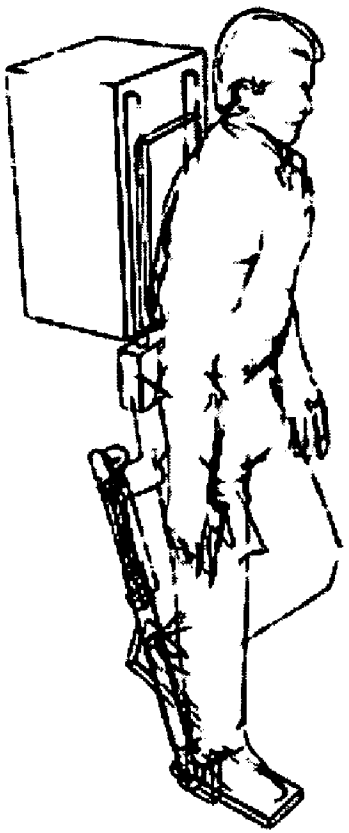
Figure 16B:
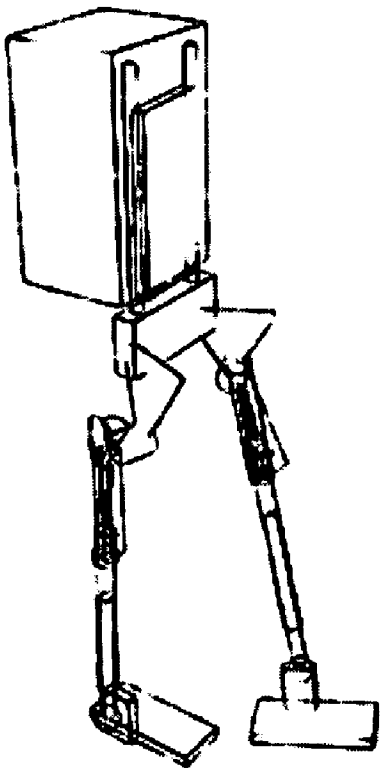
FIG. 16B is an illustration of the passive exoskeleton in the position as shown in FIG. 16A, without the user.
Figure 16A:
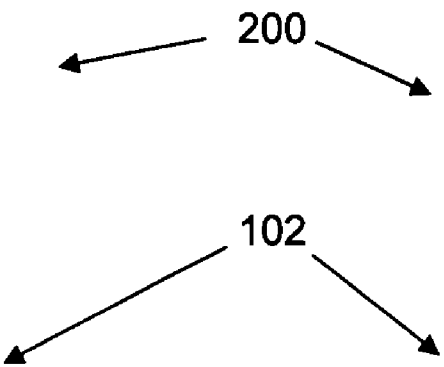
FIG. 16A is an illustration of a side perspective view of a passive exoskeleton attached with a user, where a right leg of a user is in a terminal stance of the stance phase.
Figure 16A:
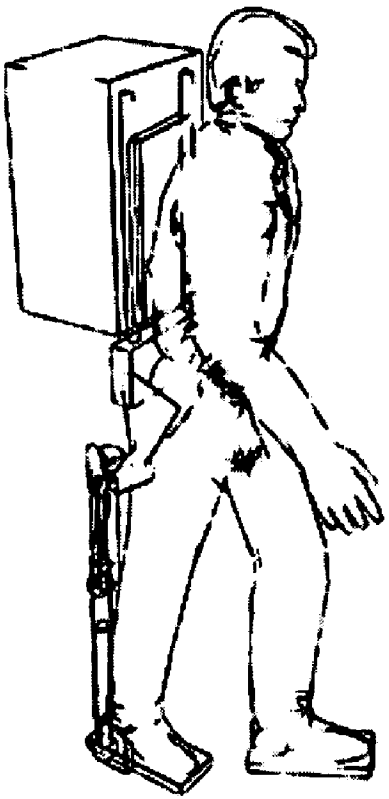
Figure 17B:
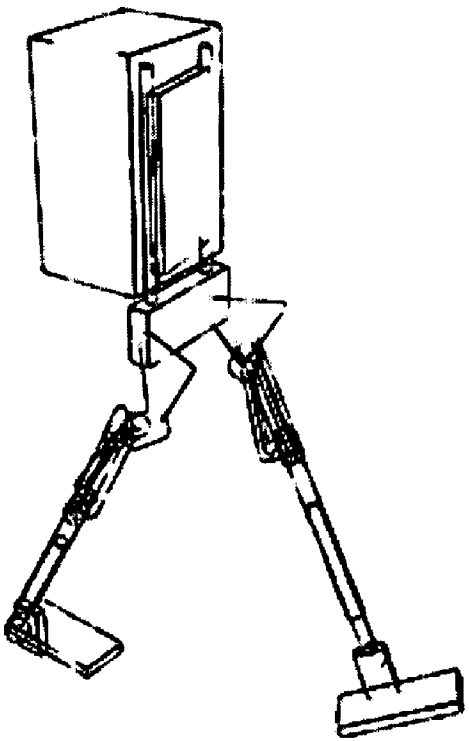
FIG. 17B is an illustration of the passive exoskeleton in the position as shown in FIG. 17A, without the user.
Figure 17A:
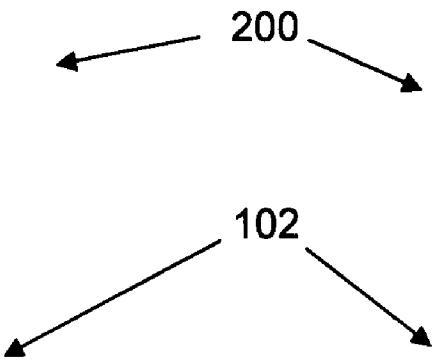
FIG. 17A is an illustration of a side perspective view of a passive exoskeleton attached with a user, where a right leg of a user is in a pre-swing of a stance phase.
Figure 17A:
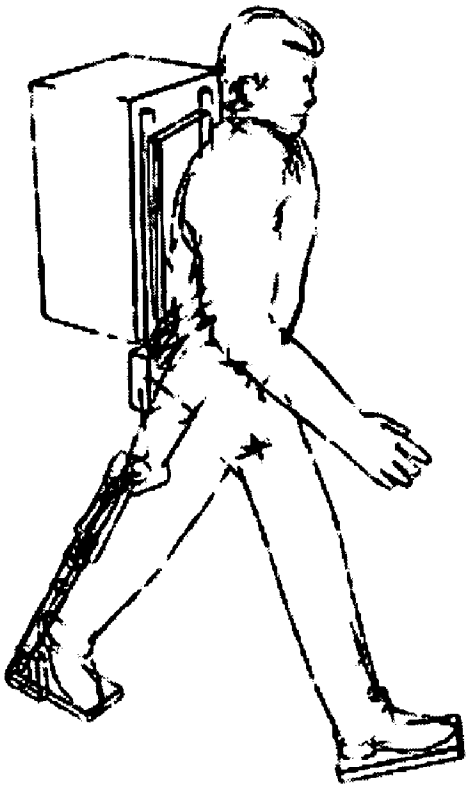
Figures 18A, 18B:
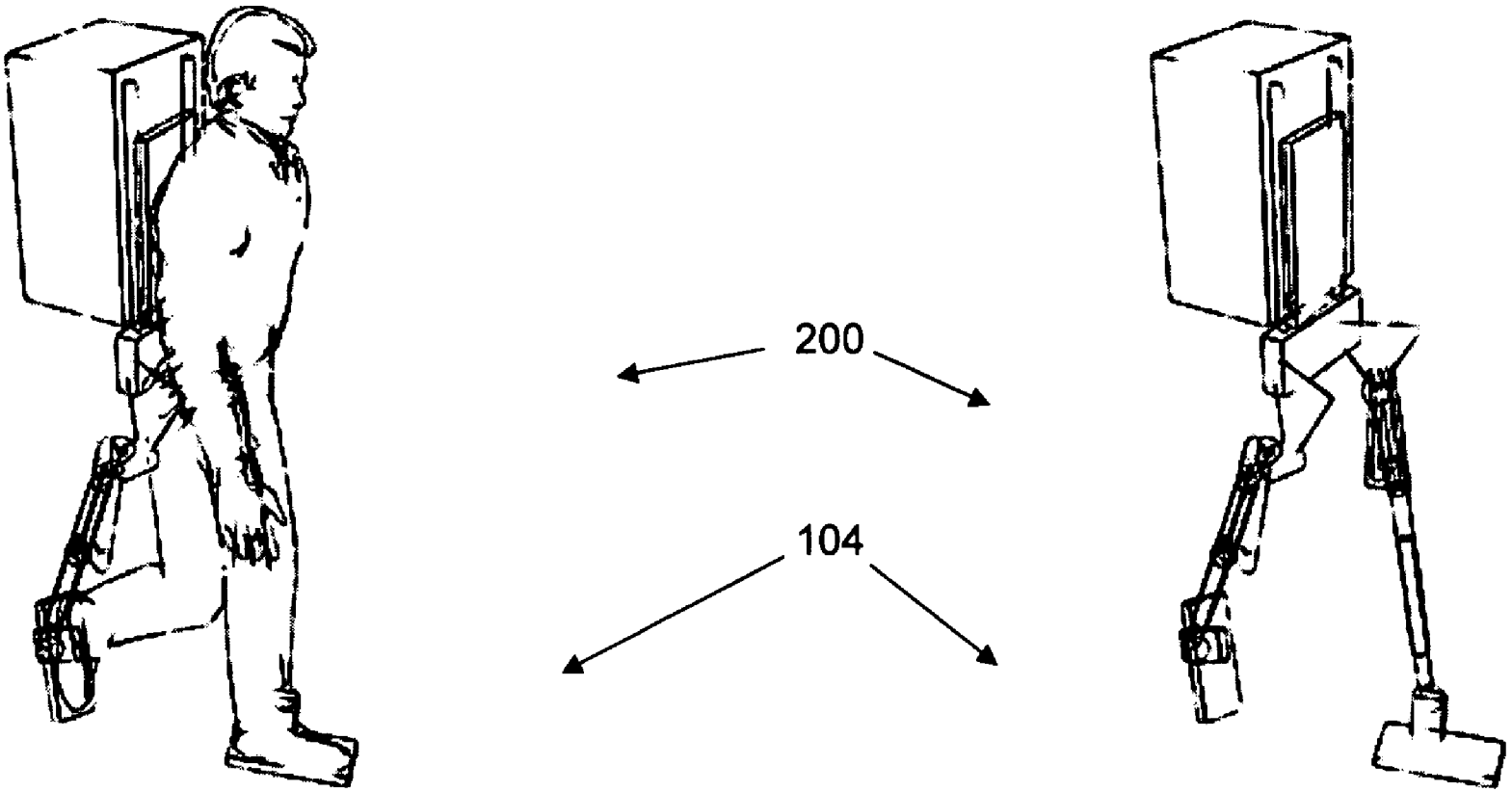
FIG. 18A is an illustration of a side perspective view of a passive exoskeleton attached with a user, where a right leg of a user is in an initial swing of the swing phase.
FIG. 18B is an illustration of the passive exoskeleton in the position as shown in FIG. 18A, without the user.
Figure 19B:
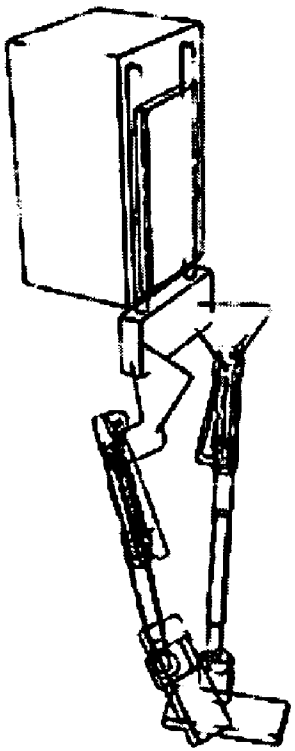
FIG. 19B is an illustration of the passive exoskeleton in the position as shown in FIG. 19A, without the user.
Figure 19A:
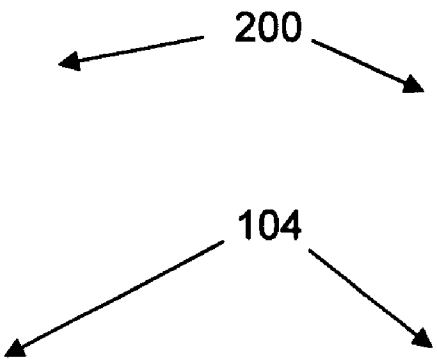
FIG. 19A is an illustration of a side perspective view of a passive exoskeleton attached with a user, where a right leg of a user is in a mid-swing of the swing phase.
Figure 19A:
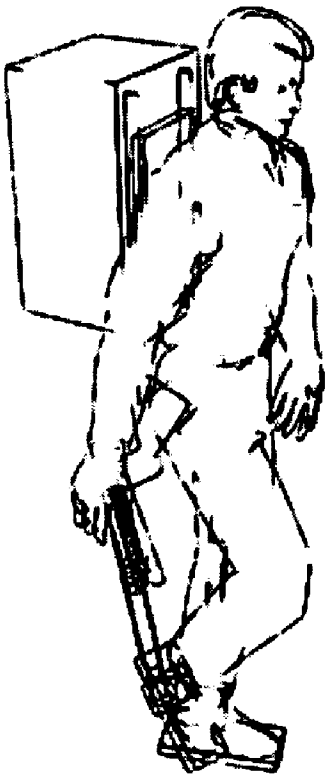
Figure 20A:
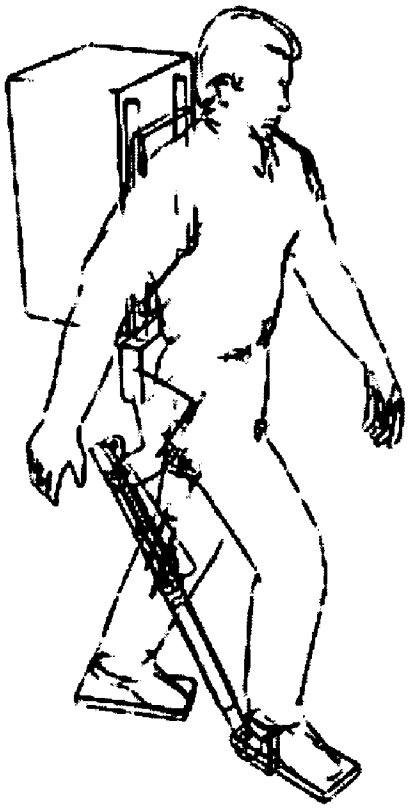
FIG. 20A is an illustration of a side perspective view of a passive exoskeleton attached with a user, where a right leg of a user is in an initial swing of the swing phase.
Figure 20B:
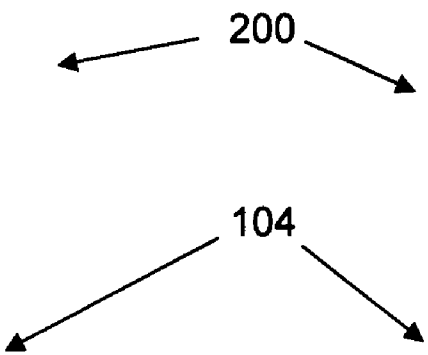
FIG. 20B is an illustration of the passive exoskeleton in the position as shown in FIG. 20A, without the user.
Figure 20B:
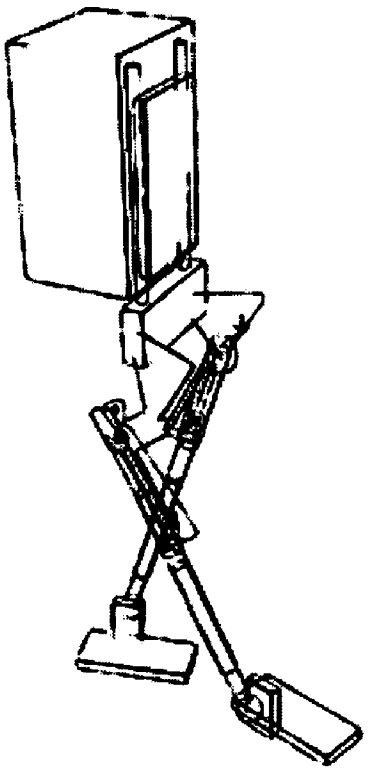
Figure 21B:
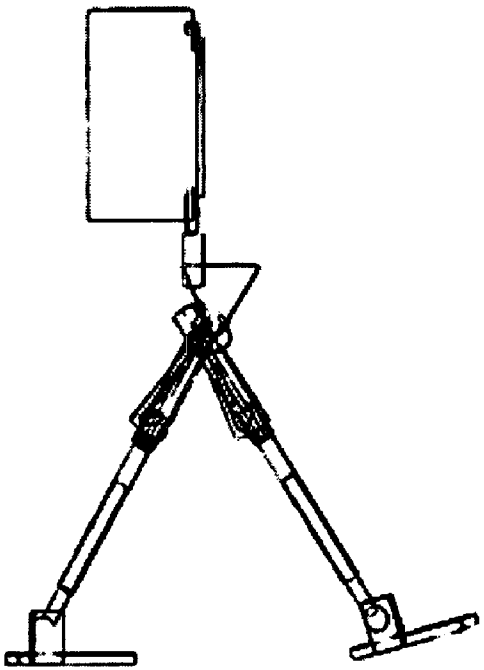
FIG. 21B is an illustration of the passive exoskeleton in the position as shown in FIG. 21A, without the user.
Figure 21A:
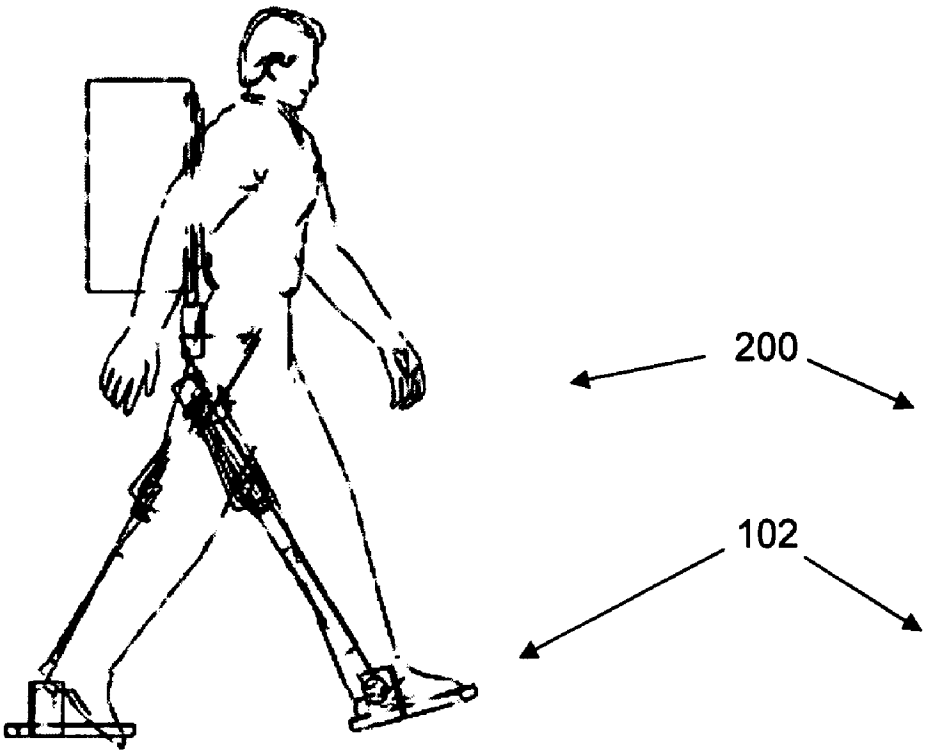
FIG. 21A is an illustration of a side view of a passive exoskeleton attached with a user, where a right leg of a user is in an initial contact of the stance phase.
Figure 22B:
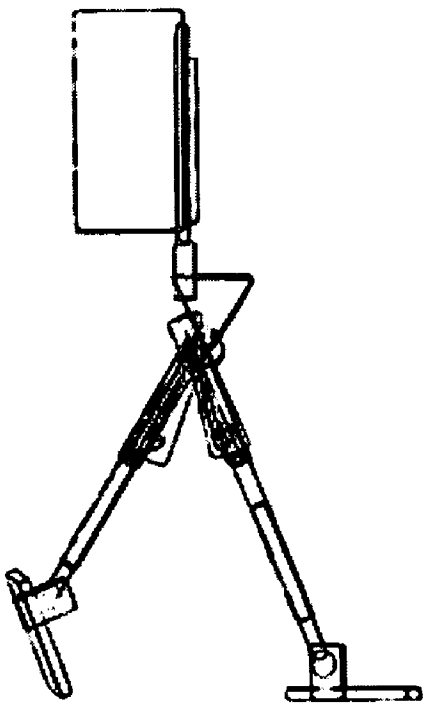
FIG. 22B is an illustration of the passive exoskeleton in the position as shown in FIG. 22A, without the user.
Figure 22A:
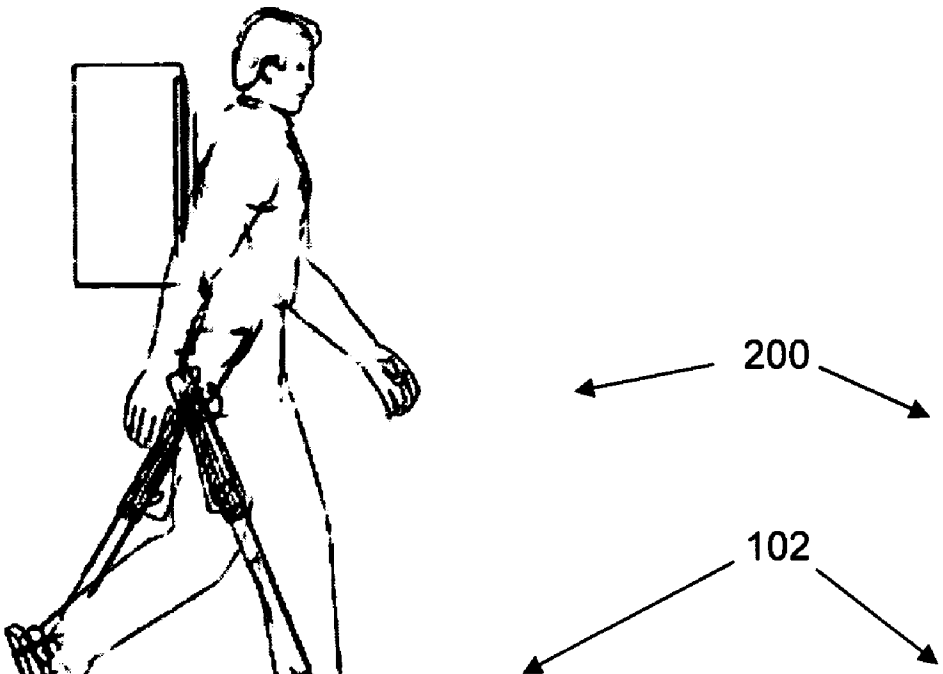
FIG. 22A is an illustration of a side view of a passive exoskeleton attached with a user, where a right leg of a user is in a loading response portion of the stance phase.
Figure 23B:
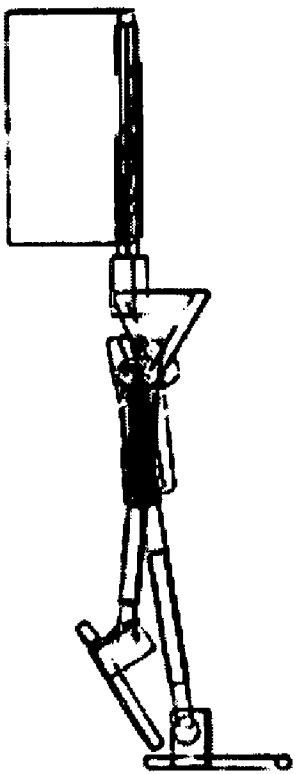
FIG. 23B is an illustration of the passive exoskeleton in the position as shown in FIG. 23A, without the user.
Figure 23A:
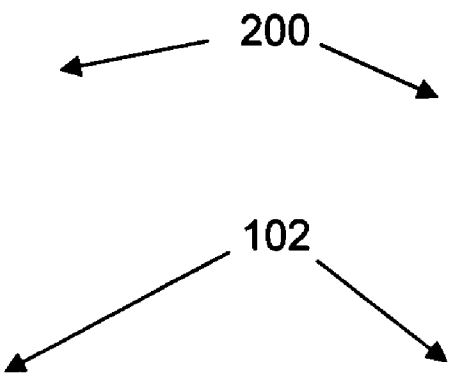
FIG. 23A is an illustration of a side view of a passive exoskeleton attached with a user, where a right leg of a user is in a mid-stance of the stance phase.
Figure 23A:
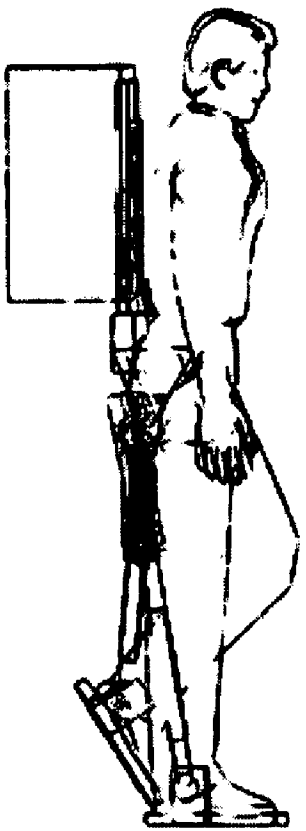
Figure 24B:
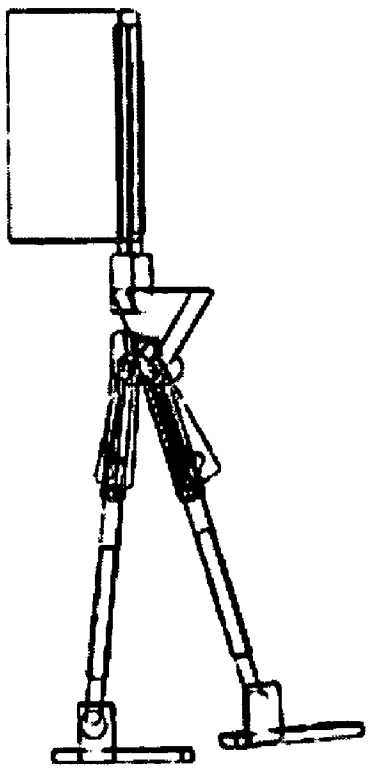
FIG. 24B is an illustration of the passive exoskeleton in the position as shown in FIG. 24A, without the user.
Figure 24A:
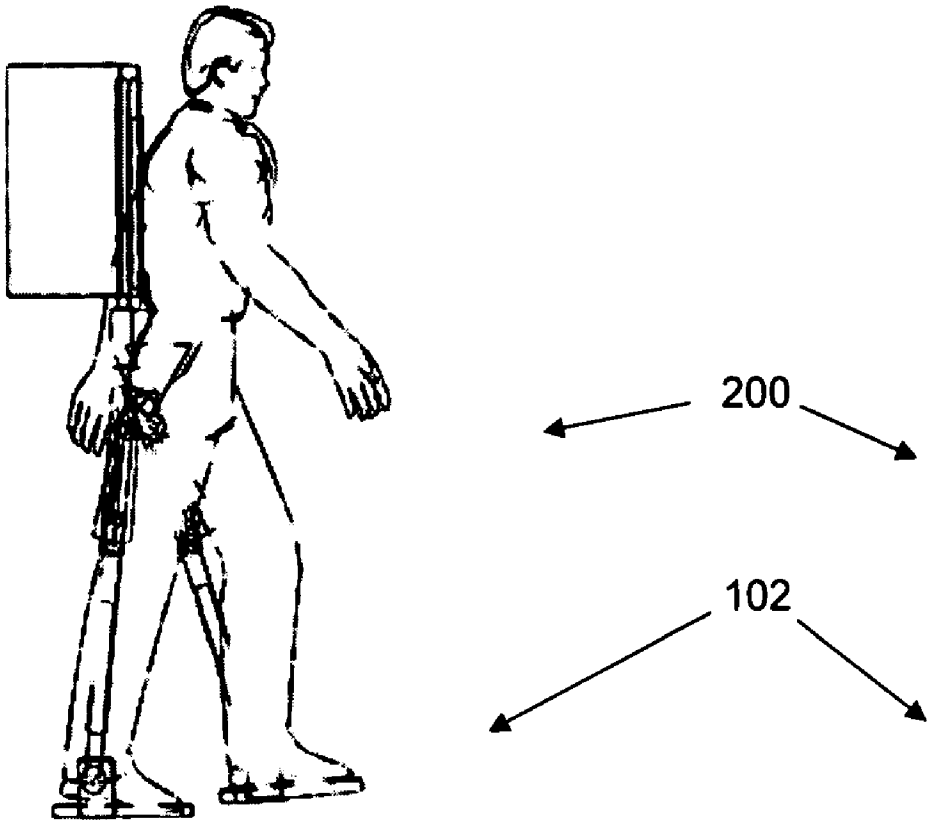
FIG. 24A is an illustration of a side view of a passive exoskeleton attached with a user, where a right leg of a user is in a terminal stance of the stance phase.
Figure 25B:
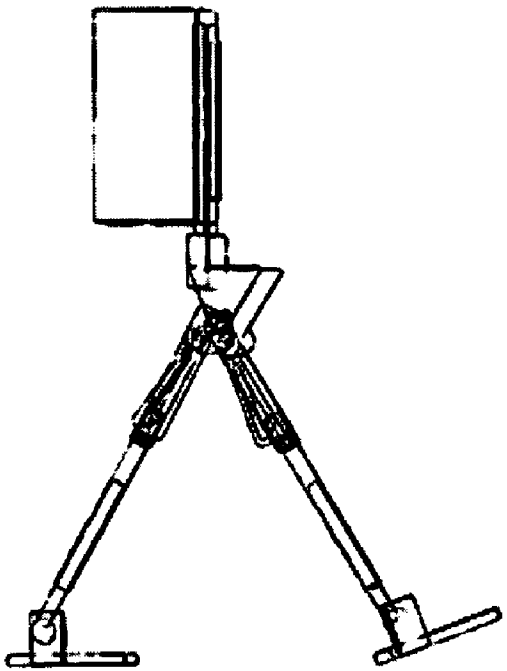
FIG. 25B is an illustration of the passive exoskeleton in the position as shown in FIG. 25A, without the user.
Figure 25A:
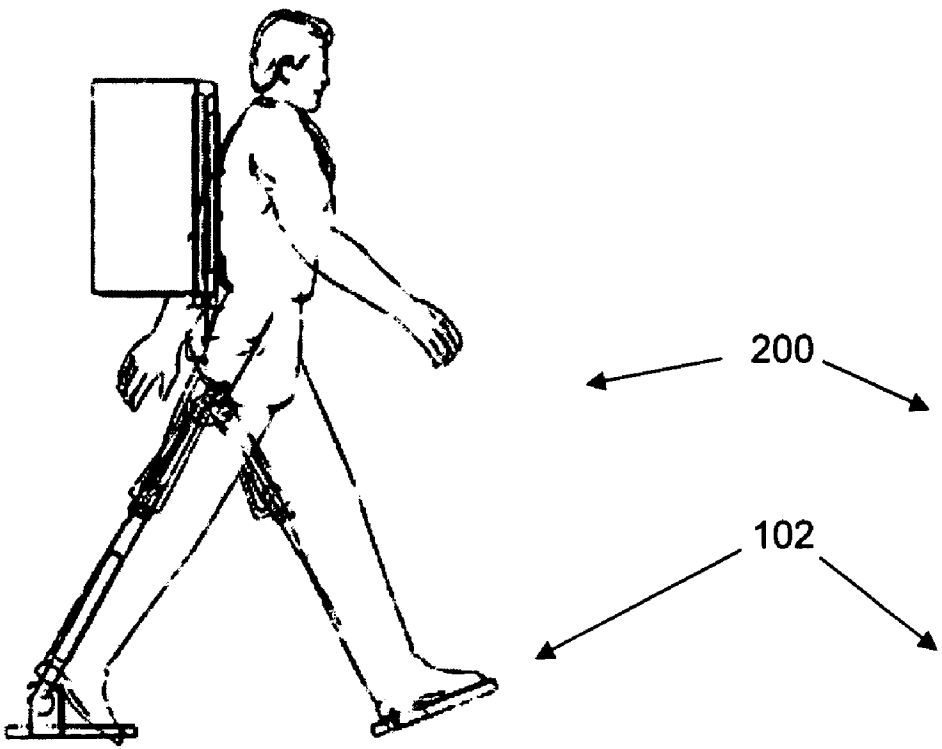
FIG. 25A is an illustration of a side view of a passive exoskeleton attached with a user, where a right leg of a user is in a pre-swing of the stance phase.
Figure 26B:
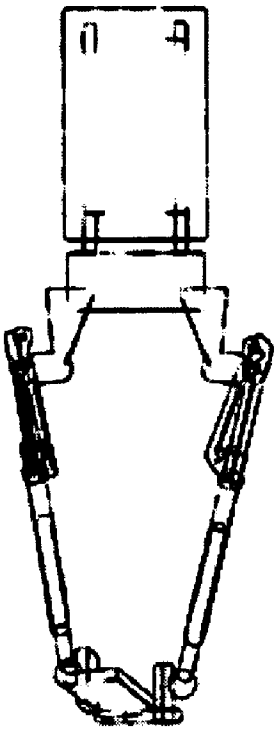
FIG. 26B is an illustration of the passive exoskeleton in the position as shown in FIG. 26A, without the user.
Figure 26A:
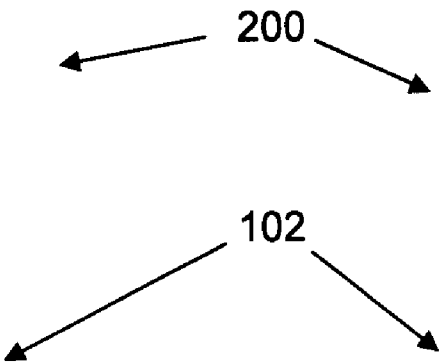
FIG. 26A is an illustration of a front view of a passive exoskeleton attached with a user, where a right leg of a user is in an initial contact of the stance phase.
Figure 26A:
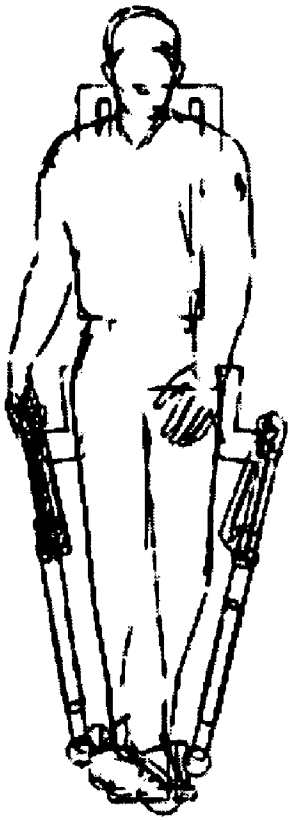
Figure 27B:
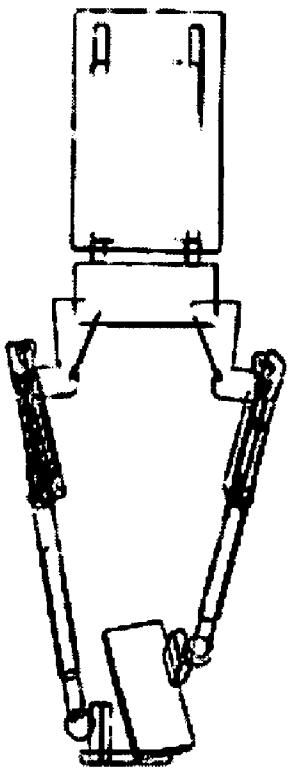
FIG. 27B is an illustration of the passive exoskeleton in the position as shown in FIG. 27A, without the user.
Figure 27A:
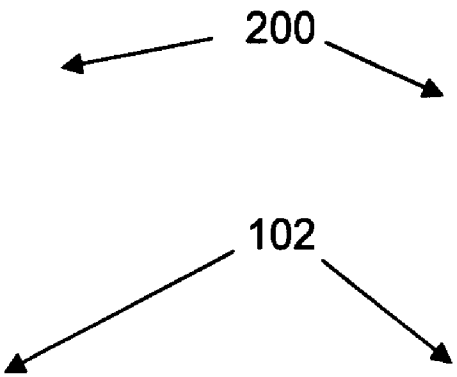
FIG. 27A is an illustration of a front view of a passive exoskeleton attached with a user, where a right leg of a user is in a loading response of the stance phase.
Figure 27A:
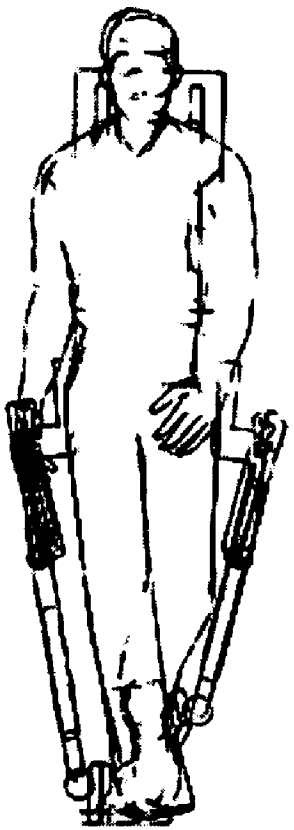
Figure 28B:
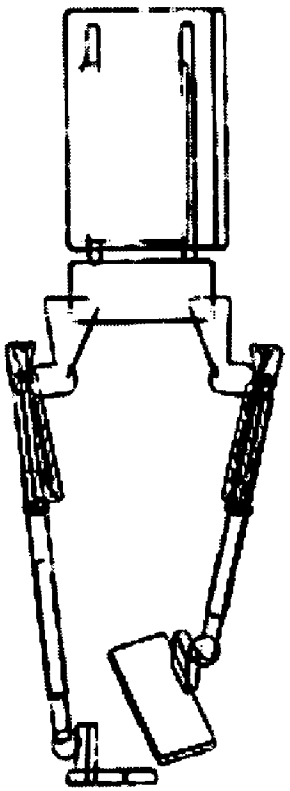
FIG. 28B is an illustration of the passive exoskeleton in the position as shown in FIG. 28A, without the user.
Figure 28A:
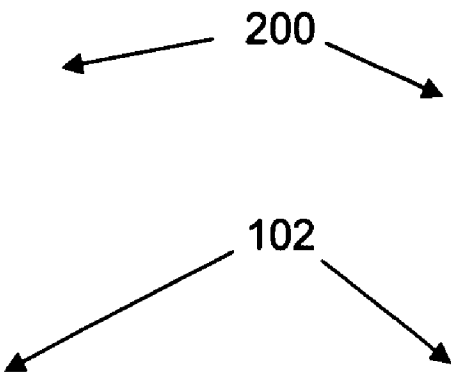
FIG. 28A is an illustration of a front view of a passive exoskeleton attached with a user, where a right leg of a user is in a mid stance of the stance phase.
Figure 28A:
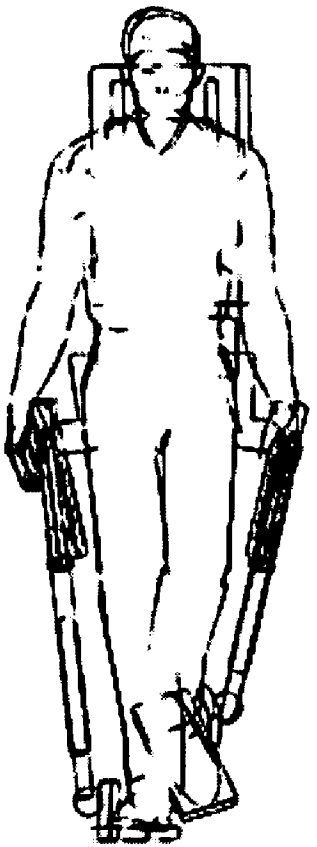
Figure 29B:
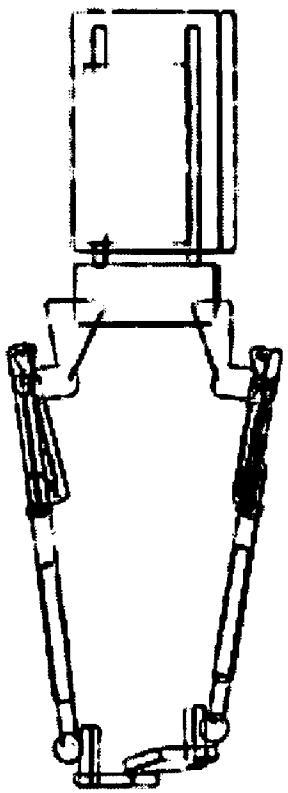
FIG. 29B is an illustration of the passive exoskeleton in the position as shown in FIG. 29A, without the user.
Figure 29A:
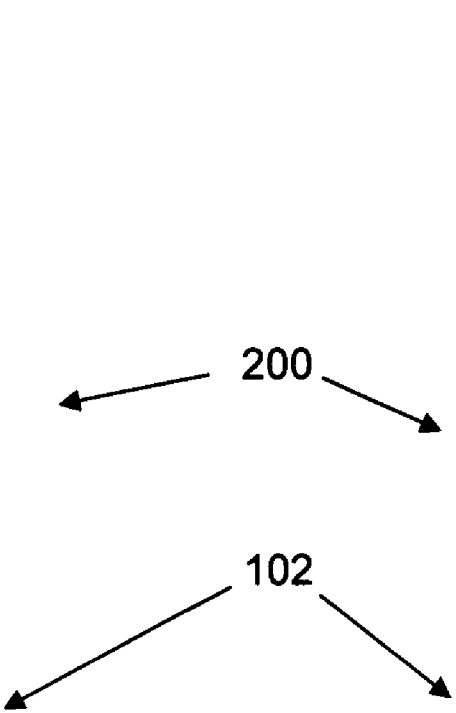
FIG. 29A is an illustration of a front view of a passive exoskeleton attached with a user, where a right leg of a user is in a terminal stance of the stance phase.
Figure 30B:
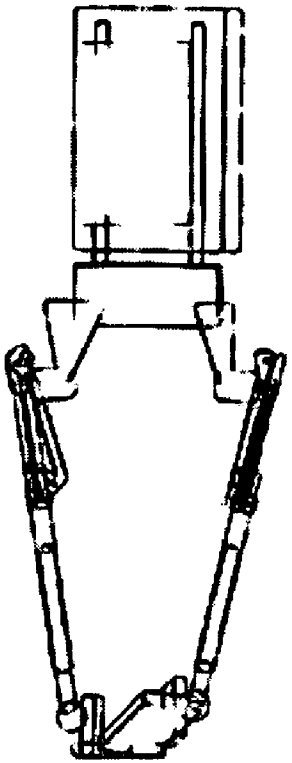
FIG. 30B is an illustration of the passive exoskeleton in the position as shown in FIG. 30A, without the user.
Figure 30A:
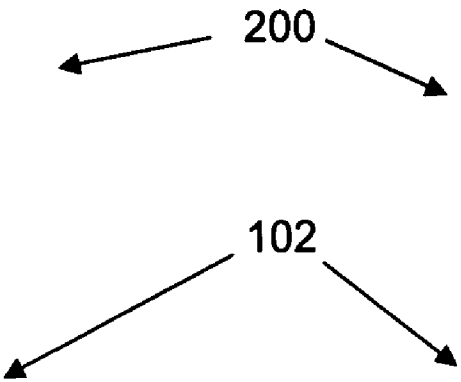
FIG. 30A is an illustration of a side view of a passive exoskeleton attached with a user, where a right leg of a user is in a pre-swing of the stance phase.
Figure 30A:
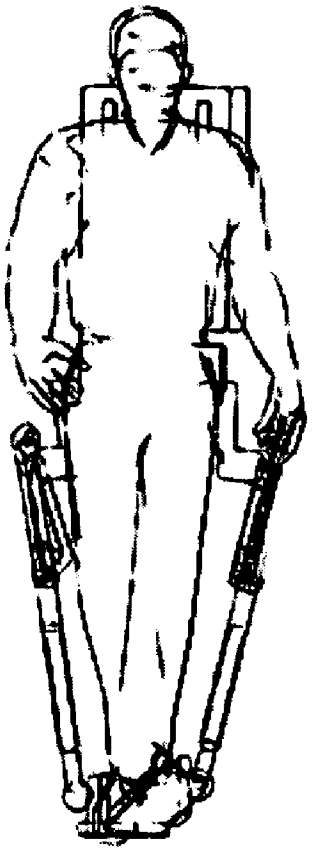

As shown in FIG. 12, before the end of the swing phase, the top component 328 hits the rear rocker stop 322. Any further motion of the leg forward 1000 causes the load pin 314 to move into and along the load channel 304, allowing the rocker 300 to take up the weight of the load after heel-strike 106.

FIGS. 13A through 20B illustrate side perspective views of a passive exoskeleton 200, both attached proximate a user (i.e. FIGS. 13A, 14A, 15A, 16A, 17A, 18A, 19A, and 20A) and without a user (i.e. FIGS. 13B, 14B, 15B, 16B, 17B, 18B, 19B, and 20B) as one side of the exoskeleton 200 travels through a stance phase 102 and thereafter a swing phase 104.

FIGS. 21A through 25B illustrate side views of a passive exoskeleton 200, both attached proximate a user (i.e. FIGS. 21A, 22A, 23A, 24A, and 25A) and without a user (i.e. FIGS. 21B, 22B, 23B, 24B, and 25B) as one side of the exoskeleton 200 travels through a stance phase 102.

FIGS. 26A through 30B illustrate front views of a passive exoskeleton 200, both attached proximate a user (i.e. FIGS. 26A, 27A, 28A, 29A, and 30A) and without a user (i.e. FIGS. 26B, 27B, 28B, 29B, and 30B) as one side of the exoskeleton 200 travels through a stance phase 102.

What is claimed is:

1. A passive exoskeleton for aiding a user in bearing a load, the passive exoskeleton comprising:

a body member for attaching proximate a portion of a user's body;

a sliding rod attached with the body member;

a rocker pivotally attached with the body member and also attached with the sliding rod, the rocker formed to transfer weight from the body member to the sliding rod during a user's stance phase; and a ground surface engage-able foot analog attached with the sliding rod, whereby a user may place a load on the body member and thereby transfer weight of the load from the body member, through the rocker and sliding rod, and into the foot analog, causing the passive exoskeleton to support at least a portion of the load;

wherein the sliding rod further comprises:

an alignment rod, where the alignment rod has a top portion, a bottom portion, and a length with an axis therethrough, and where the top portion of the alignment rod is pivotally attached with the body member; and a load rod in a fixed parallel alignment with the axis of the alignment rod, where the load rod has a top part and a bottom part, and where the load rod is connected with the alignment rod such that a length of the sliding rod is adjustable by sliding the top part of the load rod between the bottom portion and top portion of the alignment rod.

2. A passive exoskeleton as set forth in claim 1, wherein the body member is rigid, allowing the passive exoskeleton to transfer weight from the body member and through the passive exoskeleton to the ground surface.

3. A passive exoskeleton as set forth in claim 2, wherein the load rod further comprises an ankle joint attached with the bottom part of the load rod, where the ankle joint pivotally connects the load rod with the foot analog.

4. A passive exoskeleton as set forth in claim 3, wherein the rocker is pivotally attached with the body member, the rocker having a travel channel and a load channel incorporate therein, the travel channel being an elongated channel oriented directionally from proximate the body member to the ground surface, and the load channel formed as an elongated channel and positioned such that an angle between the load channel and the travel channel is less than ninety degrees; and further comprising:

a load pin attached with the top part of the load rod and operably attached with the rocker through both the travel channel and the load channel, formed such that as a user walks and shifts from a swing phase to a stance phase, the load is transferred from the body member to the rocker, the shift causing the load pin to travel between the travel channel and the load channel, thereby shifting the load from the rocker onto the load pin and thereafter through the load rod and the foot analog to the ground surface.

5. A passive exoskeleton as set forth in claim 4, wherein the rocker has a first side and a second side, and both the travel channel and the load channel are formed through the rocker from the first side to the second side.

6. A passive exoskeleton as set forth in claim 5, further comprising a front rocker stop and a rear rocker stop, the front rocker stop and the rear rocker stop being attached with the body member, and wherein the rocker further comprises a top component for engaging with both the front and rear rocker stops, formed such that when a user is walking, the rocker travels from a forward position to a rear position, and when the rocker is in a forward position, the top component engages with the rear rocker stop, and when the rocker is in a rear position, the top component engages with the front rocker stop.

7. A passive exoskeleton as set forth in claim 6, further comprising a foot connector attached with the foot analog, whereby a user may utilize the foot connector to securely attach the foot analog with the user's foot or shoe, thereby allowing the foot analog to maintain a position proximate the user's foot.

8. A passive exoskeleton as set forth in claim 7, further comprising a body attachment attached with the body member, the body attachment being selected from a group consisting of a flexible harness, a belt, and suspenders, where the body attachment is for attaching with a torso portion of a user, allowing the user to operate the exoskeleton and maintain the exoskeleton in a position proximate the user.

9. A passive exoskeleton as set forth in claim 8, further comprising a load frame attached with the body member, whereby a user may attach a load with the load frame and thereby transfer weight from the load, through the exoskeleton and to the ground surface.

10. A passive exoskeleton as set forth in claim 1, wherein the load rod further comprises an ankle joint attached with the bottom part of the load rod, where the ankle joint pivotally connects the load rod with the foot analog.

11. A passive exoskeleton as set forth in claim 1, wherein the rocker is pivotally attached with the body member, the rocker having a travel channel and a load channel incorporate therein, the travel channel being an elongated channel oriented directionally from proximate the body member to the ground surface, and the load channel formed as an elongated channel and positioned such that an angle between the load channel and the travel channel is less than ninety degrees; and further comprising:

a load pin attached with the top part of the load rod and operably attached with the rocker through both the travel channel and the load channel, formed such that as a user walks and shifts from a swing phase to a stance phase, the load is transferred from the body member to the rocker, the shift causing the load pin to travel between the travel channel and the load channel, thereby shifting the load from the rocker onto the load pin and thereafter through the load rod and the foot analog to the ground surface.

12. A passive exoskeleton as set forth in claim 11, wherein the rocker has a first side and a second side, and both the travel channel and the load channel are formed through the rocker from the first side to the second side.

13. A passive exoskeleton as set forth in claim 11, further comprising a front rocker stop and a rear rocker stop, the front rocker stop and the rear rocker stop being attached with the body member, and wherein the rocker further comprises a top component for engaging with both the front and rear rocker stops, formed such that when a user is walking, the rocker travels from a forward position to a rear position, and when the rocker is in a forward position, the top component engages with the rear rocker stop, and when the rocker is in a rear position, the top component engages with the front rocker stop.

14. A method for making a passive exoskeleton, the method comprising acts:

providing a body member configured to attach proximate a portion of a user's body;

attaching a sliding rod with the body member;

attaching a rocker pivotally attached with the body member and with the sliding rod, the rocker formed to transfer weight from the body member to the sliding rod during a user's stance phase; and attaching a ground surface engage-able foot analog with the sliding rod, whereby a user may place a load on the body member and thereby transfer weight of the load from the body member, through the rocker and sliding rod, and into the foot analog, causing the passive exoskeleton to support at least a portion of the load;

wherein in the act of attaching a sliding rod with the body member, the sliding rod further comprises:

an alignment rod, where the alignment rod has a top portion, a bottom portion, and a length with an axis therethrough, and where the top portion of the alignment rod is pivotally attached with the body member; and a load rod in a fixed parallel alignment with the axis of the alignment rod, where the load rod has a top part and a bottom part, and where the load rod is connected with the alignment rod such that a length of the sliding rod is adjustable by sliding the top part of the load rod between the bottom portion and top portion of the alignment rod.

* * * * *